US007995006B2

(12) United States Patent
Takeda et al.

(10) Patent No.: US 7,995,006 B2
(45) Date of Patent: Aug. 9, 2011

(54) METHOD OF DRIVING PLASMA DISPLAY PANEL, AND PLASMA DISPLAY DEVICE

(75) Inventors: Minoru Takeda, Osaka (JP); Shigeo Kigo, Osaka (JP); Yasuaki Mutou, Osaka (JP)

(73) Assignee: Panasonic Corporation, Osaka (JP)

( * ) Notice: Subject to any disclaimer, the term of this patent is extended or adjusted under 35 U.S.C. 154(b) by 1002 days.

(21) Appl. No.: 11/885,968

(22) PCT Filed: Feb. 13, 2007

(86) PCT No.: PCT/JP2007/052473

§ 371 (c)(1),
(2), (4) Date: Sep. 10, 2007

(87) PCT Pub. No.: WO2007/094294

PCT Pub. Date: Aug. 23, 2007

(65) Prior Publication Data

US 2008/0284681 A1 Nov. 20, 2008

(30) Foreign Application Priority Data

Feb. 14, 2006 (JP) ..... 2006-036326
Feb. 14, 2006 (JP) ..... 2006-036327
Feb. 14, 2006 (JP) ..... 2006-036329
Dec. 7, 2006 (JP) ..... 2006-330196

(51) Int. Cl.
*G09G 3/28* (2006.01)

(52) U.S. Cl. ..... 345/63; 345/60; 345/67

(58) Field of Classification Search ..... 345/60–69, 345/211, 204, 690

See application file for complete search history.

(56) References Cited

U.S. PATENT DOCUMENTS

2002/0158822 A1 10/2002 Ishizuka et al.
2003/0030598 A1 2/2003 Kanazawa et al.
2004/0239593 A1* 12/2004 Yamada ..... 345/63
2005/0156823 A1 7/2005 Kang et al.
2005/0162344 A1 7/2005 Kang et al.
2005/0212723 A1* 9/2005 Chung et al. ..... 345/60
2005/0219156 A1* 10/2005 Tachibana et al. ..... 345/63
2005/0225509 A1 10/2005 Choi et al.

(Continued)

FOREIGN PATENT DOCUMENTS

EP 1 531 451 5/2005

(Continued)

OTHER PUBLICATIONS

International Search Report of Mar. 27, 2007 issued in International Application No. PCT/JP2007/052473.

(Continued)

*Primary Examiner* — Duc Dinh
(74) *Attorney, Agent, or Firm* — Wenderoth, Lind & Ponack, L.L.P.

(57) ABSTRACT

One field is formed of a plurality of sub-fields, and each one of the sub-fields includes an initializing period, addressing period, and sustained period. The sub-field is one of an entire-cell initialization sub-field or a selective-cell initialization sub-field. When the entire initialization sub-field is switched to the selective one or vice versa, an initializing voltage which generates initializing discharge in the entire initialization sub-field is controlled. This control allows varying the number of the entire initializations and stabilizing address discharge in a plasma display panel, and at the same time, making the black luminance inconspicuous for improving the picture quality.

9 Claims, 17 Drawing Sheets

U.S. PATENT DOCUMENTS

| | | | |
|---|---|---|---|
| 2006/0152446 | A1 | 7/2006 | Yamashita |
| 2006/0227076 | A1 | 10/2006 | Kim |

FOREIGN PATENT DOCUMENTS

| | | |
|---|---|---|
| EP | 1 596 356 | 11/2005 |
| EP | 1 710 776 | 10/2006 |
| JP | 2000-242224 | 9/2000 |
| JP | 2002-328648 | 11/2002 |
| JP | 2003-50562 | 2/2003 |
| JP | 2003-108063 | 4/2003 |
| JP | 2005-148746 | 6/2005 |
| JP | 2005-215132 | 8/2005 |
| JP | 2005-338217 | 12/2005 |

OTHER PUBLICATIONS

Supplementary European Search Report issued Jul. 12, 2010 in Application No. EP 07 71 4055.

* cited by examiner

FIG. 11

(Bad 0 ⟷ 10 Excellent)
8 ≤ Allowable range ≤ 10

| Change time (sec) | 0.1 | 0.2 | 0.4 | 0.8 | 1.6 | 3.2 | 6.4 |
|---|---|---|---|---|---|---|---|
| Flicker | 10 | 10 | 9 | 8 | 7 | 6 | 5 |
| Change in black luminance | 5 | 8 | 8 | 8 | 8 | 9 | 9 |

METHOD OF DRIVING PLASMA DISPLAY PANEL, AND PLASMA DISPLAY DEVICE

This Application is a U.S. National Phase Application of PCT International Application PCT/JP2007/052473.

TECHNICAL FIELD

The present invention relates to a method of driving a plasma display panel to be used in wall-mounted television receivers or large-size monitors, and it also relates to a plasma display device.

BACKGROUND ART

A plasma display panel (hereinafter simply referred to as "panel"), typically an AC surface discharge panel, comprises numbers of discharge cells formed between a front plate and a back plate confronting each other.

The front plate comprises display electrode pairs each one of which is formed of a scan electrode and a sustain electrode, and the display electrode pairs are formed in parallel to each other on a front glass substrate. A dielectric layer and a protective layer are formed such that those two layers cover the display electrode pairs. The back plate comprises a plurality of data electrodes formed in parallel to each other and on a back glass substrate, a dielectric layer covering the plurality of data electrodes, and a plurality of barrier ribs formed in parallel with the data electrodes and on the dielectric layer. The dielectric layer has a phosphor layer on its surface, and the barrier ribs have phosphor layers on their lateral faces.

The front plate confronts the back plate such that the display electrode pairs and the data electrodes form two-level crossings. The front plate and the back plate are sealed, and discharge gas is filled in a discharge space of the sealed body. The discharge gas includes, e.g. xenon at 5% partial pressure ratio. In the foregoing panel, gas-discharge in respective discharge cells will generate ultraviolet rays, which then excite the phosphors and emit light in respective colors, i.e. Red, Green and Blue, thereby displaying a color display.

A sub-field method is widely used for driving the panel. According to this method, one field period is divided into a plurality of sub-fields, then a combination of the sub-fields, which are supposed to emit light, allows displaying a gradation.

Each one of sub-fields has an initializing period, an addressing period, and a sustained period. During the initializing period, an initializing discharge takes place, so that wall charges necessary for addressing performance coming next are formed on the respective electrodes. To be more specific, there are two types of initialization, one is an entire initialization, i.e. the cells involved are entirely initialized for generating an initializing discharge (hereinafter referred to an entire initialization), and the other is a selective initialization, i.e. only the discharge cells that carried out the sustain discharge are selected and initialized for generating an initializing discharge (hereinafter referred to as a selective initialization).

During the addressing period, an address discharge is generated selectively at discharge cells to be used for displaying, so that wall charges are formed. During the sustained period, a sustain pulse is applied to alternately the display electrode pair formed of a scan electrode and a sustain electrode, thereby generating sustain discharges at the discharge cells where address discharges are take place, and illuminating the phosphor layers of the corresponding discharge cells. A video can be thus displayed.

There is another sub-field method, which uses a voltage waveform gently changing for the initializing discharge to take place, and the initializing discharge also takes place selectively at discharge cells in which sustain discharges have taken place, so that light emission not involved with the grayscale display can be reduced as much as possible. This method thus can increase the contrast ratio. To be more specific, e.g. during the initializing period of a sub-field among a plurality of sub-fields, an entire initialization is carried out, i.e. the entire cells are initialized for discharging, and during the initializing periods of the other sub-fields, a selective initialization takes place for initializing the selected discharge cells in which sustain discharges have taken place. As a result, light emission not involved with the display takes place only at the light emission accompanying the entire initialization, so that a display at a greater contrast ratio is obtainable (e.g. refer to cited patent reference 1.)

The driving method discussed above needs light emission not involved with the video display, i.e. luminance in black-display area at no video (hereinafter referred to simply as "black luminance") is formed of only faint light emission accompanying the entire initialization, so that a video at a higher contrast ration can be displayed.

Panels having a higher resolution and a larger screen are introduced in the market, and this market trend needs the more numbers of discharge cells. On top of that, the number of sub-fields needs to increase for improving a pseudo contour of a dynamic picture image as well as a picture quality. These requirements need a higher speed of addressing performance.

The entire initialization that initializes all the discharge cells not only forms wall charges necessary for the addressing performance as discussed above, but also generates a priming that decreases a discharge delay and steadily generates the address discharge. Thus increment of the priming is effective to perform the addressing operation at a higher speed. However, a simple increment of the number of the entire initializations raises the black luminance, and lowers the contrast ratio, so that the picture quality is lowered.

Another driving method for overcoming the foregoing problem is disclosed in, e.g. cited patent reference 2: Based on the average picture level (APL) of a video signal to be displayed, the initialization during the initializing period of respective sub-fields is determined to be an entire initialization or a selective initialization, so that the number of the entire initializations can be varied, which allows steady addressing at a higher speed while the rise of black luminance is suppressed.

However, the variation in the number of the entire initializations as discussed above sometimes discontinuously varies the black luminance that should be kept constant, and then the picture quality is lowered. Meanwhile the number of sub-fields in one field, in which sub-fields the entire initializations take place, is referred to as the number of entire initializations. The cited patent references 1 and 2 discussed above are actually the following ones:

Cited patent reference 1: Unexamined Japanese Patent Publication No. 2000-242224, and Cited patent reference 2: Unexamined Japanese Patent Publication No. 2005-215132.

DISCLOSURE OF INVENTION

The present invention aims to provide a method of driving a plasma display panel and a plasma display device, both of which method and device allow improving the picture quality by varying the number of entire initializations for stabilizing address discharges and for suppressing variations in the black luminance.

The present invention discloses a method of driving the panel including a plurality of discharge cells each one of which has a display electrode pair formed of a scan electrode and a sustain electrode. One field is formed of a plurality of sub-fields each one of which is formed of an initializing period where a discharge cell generates an initializing discharge, an addressing period where the discharge cell generates an address discharge, and a sustained period where the discharge cell, in which the address discharge has taken place, generates a sustain discharge.

The driving method comprises the steps of:

setting a sub-field to be an entire initialization sub-field in which all the discharge cells to be used for video display are initialized during the initializing period or setting a sub-field to be a selective initialization sub-field in which the discharge cells, where a sustain discharge has taken place in the immediate previous sub-field, selectively generate an initializing discharge; and controlling an initializing voltage which generates the initializing discharge at the entire initialization sub-field in switching the entire initialization sub-field to/from the selective initialization sub-field.

This method allows varying the number of the entire initializations on the panel, and stabilizing the address discharge as well as suppressing variations in the black luminance. As a result, the panel driving method that can improve the picture quality is obtainable.

The panel driving method of the present invention preferably sets an initializing voltage of at least one sub-field of the entire initialization sub-fields in the field immediately previous to the field where the number of the entire initialization sub-fields is to be increased higher than the initializing voltages of at least two sub-fields of the entire initialization sub-fields of the field immediately after the field where the number of entire initialization sub-fields has been decreased. The method also preferably sets an initializing voltage of at least two sub-fields of the entire initialization sub-fields in the field immediately previous to the field where the number of entire initialization sub-fields is to be decreased lower than an initializing voltage of at least one sub-field of the entire initialization sub-fields in the field immediately after the field where the number of the entire initialization sub-fields has been decreased.

The panel driving method of the present invention can increase the initializing voltage of the entire initialization sub-fields in one field step by step during a plurality of field periods in series, and then switch a selective initialization sub-field to an entire initialization sub-field.

The panel driving method of the present invention can switch one of the entire initialization sub-fields in one field to a selective initialization sub-field, and then lower an initializing voltage of at least one sub-field of the remaining entire initializing sub-fields step by step during a plurality of field periods in series.

The panel driving method of the present invention preferably increases an initializing voltage of an entire initialization sub-field in one field over a period of 0.2-1.6 seconds, and then switches a selective initialization sub-field to an entire initialization sub-field.

The panel driving method of the present invention can switch one of the entire initialization sub-fields in one field to a selective initialization sub-field, and then lowers an initializing voltage of at least one of the remaining entire initialization sub-fields over a period of 0.2-1.6 seconds.

The methods discussed above allows varying the number of the entire initializations in the panel, thereby stabilizing the address discharge as well as suppressing variations in the black luminance. As a result, the panel driving method that can improve the picture quality is obtainable.

A plasma display device of the present invention comprises the following elements:

a panel including a plurality of discharge cells having a display electrode pair formed of a scan electrode and a sustain electrode; and a scan-electrode driving circuit for applying a voltage, shaped in inclined waveform gently increasing or decreasing, to the scan electrode.

One field is formed of a plurality of sub-fields, each one of which includes an initializing period where a discharge cell generates an initializing discharge, an addressing period where a discharge cell generates an address discharge, and a sustained period where the discharge cell, in which the address discharge has taken place, generates a sustain discharge. The sub-field is either one of an entire initialization sub-field in which an initializing discharge takes place during the initializing period at all the discharge cells to be used for video display, or a selective initialization sub-field in which the discharge cells, where a sustain discharge has taken place in the immediate previous sub-field, selectively generate an initializing discharge. The scan-electrode driving circuit switches over the entire initialization sub-field to/from the selective initialization sub-field, and controls the initializing voltage, i.e. the maximum value of the voltage shaped in the inclined waveform which can generates the initializing discharge in the entire initialization sub-field.

The structure discussed above allows varying the number of entire initializations in the panel, thereby stabilizing the address discharge as well as suppressing variations in the black luminance. As a result, the plasma display device that can improve the picture quality is obtainable.

The scan electrode driving circuit of the plasma display device of the present invention raises an initializing voltage of an entire initialization sub-field in one field step by step for 0.2-1.6 seconds, and then desirably switches the selective initialization sub-field to the entire initialization sub-field.

The scan electrode driving circuit of the plasma display device of the present invention switches one of the entire initialization sub-fields in one filed to the selective initialization sub-field, and then desirably lowers an initializing voltage of at least one sub-field of the remaining entire initialization sub-fields step by step for 0.2-1.6 seconds.

The scan electrode driving circuit of the plasma display device of the present invention switches a selective initialization sub-field to an entire initialization sub-field, and in the field immediately after this switch-over, the circuit desirably sets an initializing voltage of the entire initialization sub-field lower than that of the other entire initialization sub-fields.

The scan electrode driving circuit of the plasma display device of the present invention switches one of the entire initialization sub-fields in one field to a selective initialization sub-field, and in the field immediately before this switch-over the circuit desirably sets an initializing voltage of an entire initialization sub-field lower than that of the remaining entire initialization sub-fields.

BRIEF DESCRIPTION OF THE DRAWINGS

FIG. 11 shows an evaluation on the allowance about the variations in flicker and black luminance with respect to the change time of the plasma display device in accordance with the fifth embodiment of the present invention.

DESCRIPTION OF REFERENCE MARKS

Figure 1:
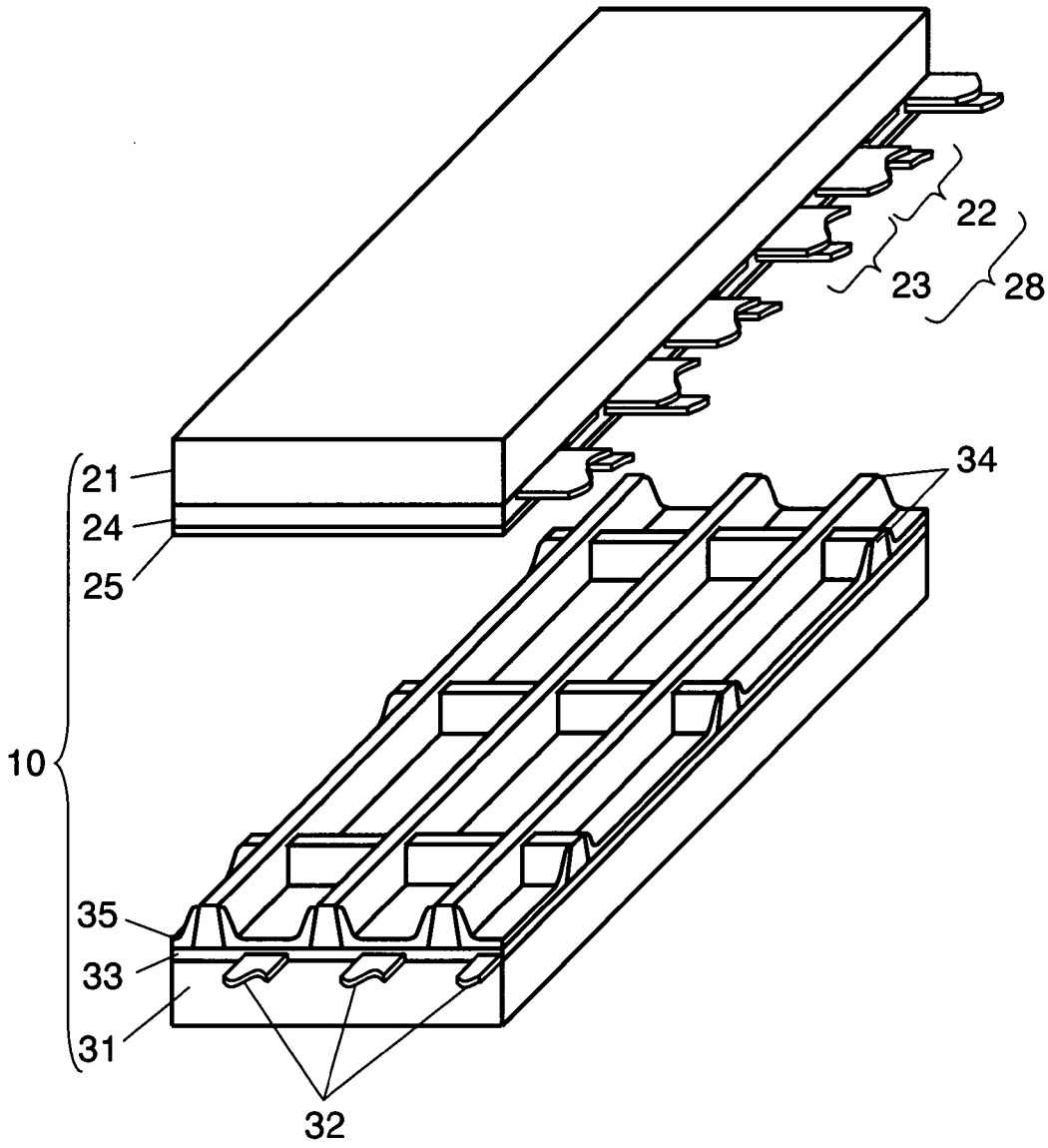
FIG. 1 shows a perspective exploded view illustrating a structure of a panel in accordance with a first embodiment of the present invention.

1 plasma display device
10 panel
21 front plate
22 scan electrode
23 sustain electrode
24, 33 dielectric layer
25 protective layer
28 display electrode pair
31 back plate
32 data electrode
34 barrier rib
35 phosphor layer
51 video-signal processing circuit
52 data-electrode driving circuit
53 scan-electrode driving circuit
54 sustain-electrode driving circuit
55 timing generator circuit
57 APL detector circuit
100 sustain pulse generator circuit
110 power recovery circuit
300 initializing waveform generator circuit
310, 320 Miller integrator circuit
400 scan-pulse generator circuit

DESCRIPTION OF PREFERRED EMBODIMENTS

A plasma display device of the present invention is demonstrated hereinafter with reference to the accompanying drawings.

Exemplary Embodiment 1

FIG. 1 shows a perspective exploded view illustrating a structure of panel 10 in accordance with the first embodiment of the present invention. Front plate 21 made of glass has a plurality of display electrode pairs 28 on its surface, and each one of pairs 28 is formed of scan electrode 22 and sustain electrode 23. Dielectric layer 24 is formed such that layer 24 covers scan electrode 22 and sustain electrode 23. Back plate 31 has a plurality of data electrodes 32 on its surface, and dielectric layer 33 is formed such that layer 33 covers data electrodes 32. On top of dielectric layer 33, barrier ribs 34 are formed in a grid pattern, and phosphor layers 35 are provided on the lateral faces of barrier ribs 34 and on the dielectric layer 33. Phosphor layers 35 illuminate in red (R), green (G), and blue (B) respectively.

Front plate 21 and back plate 31 are confronted each other with a little discharge space in between, and display electrode pair 28 and data electrode 32 sandwich this small discharge space and cross each other. Front plate 21 and back plate 31 confronting each other are sealed at their circumferences with sealing member such as glass frit. The discharge space is filled with discharging gas, e.g. mixed gas of neon and xenon. In this first embodiment, a discharging gas including xenon at 10% partial pressure ratio is used for producing higher luminance. The discharging space is partitioned into a plurality of cells by barrier ribs 34, and a discharge cell is formed at the intersection of display electrode pair 28 and data electrode 32. Each one of the discharge cells discharges and emits light, whereby a video can be displayed. The structure of the panel is not limited to the foregoing one, and a panel can include barrier ribs in striped pattern.

Figure 2:
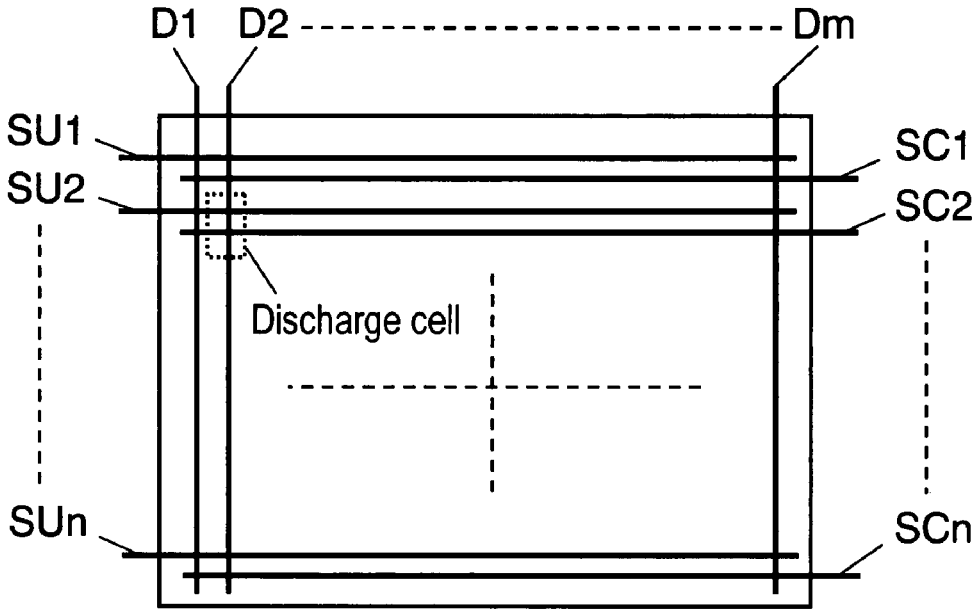
FIG. 2 shows electrode-arrays in the panel in accordance with the first embodiment of the present invention.

FIG. 2 shows an electrode-array in panel 10 in accordance with the first embodiment of the present invention. Scan electrodes SC1-SCn (scan electrodes 22 shown in FIG. 1) and sustain electrodes SU1-SUn (sustain electrodes 23 shown in FIG. 1) are arrayed in panel 10, and both of the electrodes are stretched along the line direction. Data electrodes D1-Dm (data electrodes 32 shown in FIG. 1) are also arrayed in panel 10, and they are stretched along the row direction. A discharge cell is formed at an intersection of a pair of scan electrode SCi (i=1–n) and sustain electrode SUi with data electrode Dj (j=1–m), and "m×n" discharge cells are formed in the discharge space.

Figure 3:
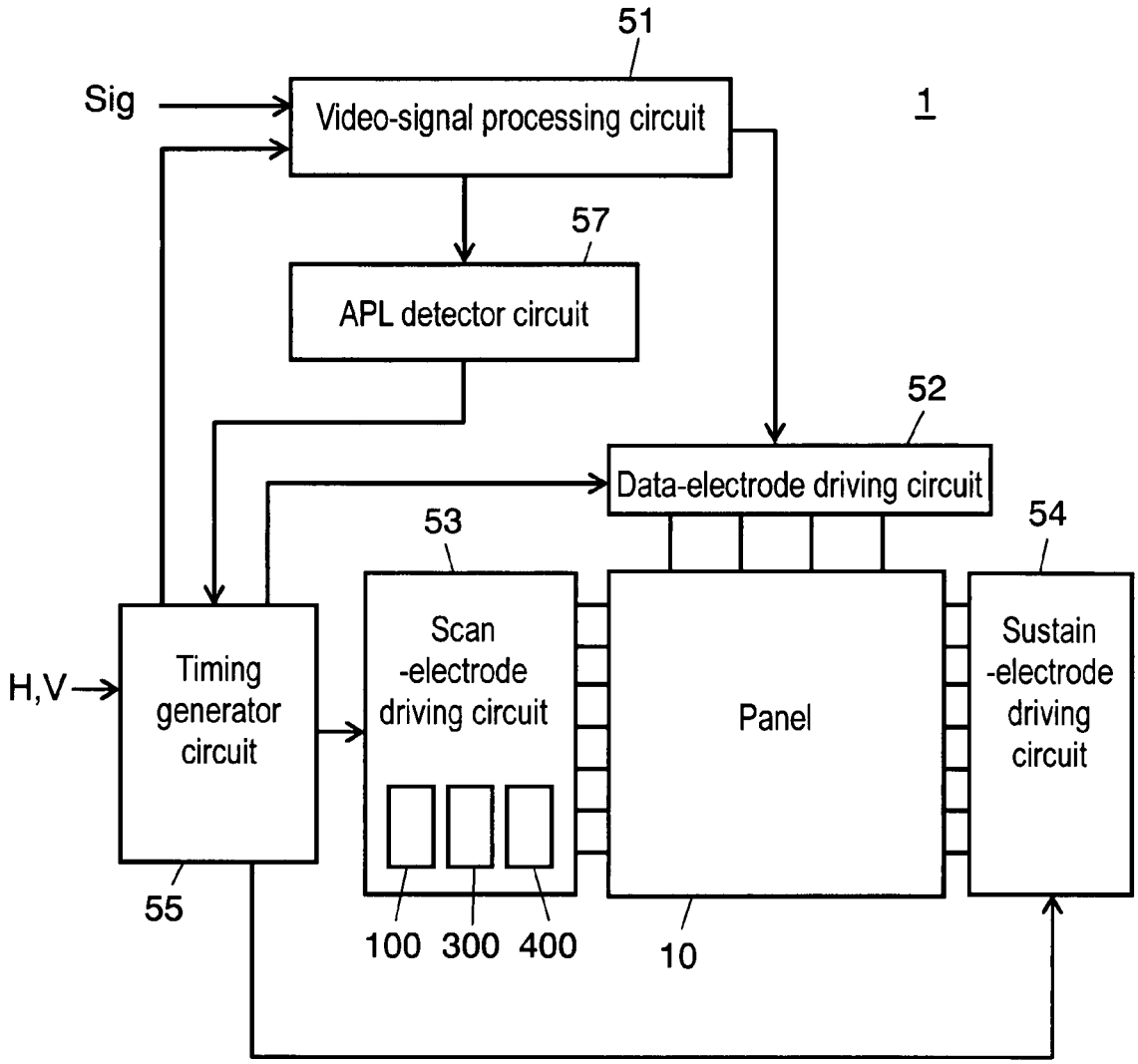
FIG. 3 shows a circuit block diagram of a plasma display device in accordance with the first embodiment of the present invention.

FIG. 3 shows a circuit block diagram of plasma display device 1 in accordance with the first embodiment of the present invention. Plasma display device 1 comprises the following elements: panel 10, video signal processing circuit 51, data electrode driving circuit 52, scan electrode driving circuit 53, sustain electrode driving circuit 54, timing generator circuit 55, APL detector circuit 57, and a power supply circuit (not shown) for powering the respective circuit blocks.

Video signal processing circuit 51 converts input video signal Sig to video data indicating a light emission or a non-light emission about respective sub-fields. Data electrode driving circuit 52 converts the video data of the respective sub-fields to signals corresponding to data electrodes D1-Dm, and drives data electrodes D1-Dm. APL detector circuit 57 detects an average luminance level (APL) of video signal Sig. To be more specific, the APL can be detected by a known method, e.g. accumulating the luminance value of a video signal for one field period or one frame period.

Timing generator circuit 55 generates various timing signals based on horizontal sync signal H, vertical sync signal V and APL detected by APL detector circuit 57, and supplies these timing signals to the respective circuit blocks for controlling each one of the blocks. Scan electrode driving circuit 53 includes initializing waveform generator circuit 300 for generating an initializing voltage waveform to be applied to scan electrodes SC1-SCn during the initializing period. Driving circuit 53 drives scan electrodes SC1-SCn based on the timing signal. Sustain electrode driving circuit 54 drives sustain electrodes SU1-SUn based on the timing signal.

Next, a voltage waveform for driving panel 10 is described and its operation is demonstrated hereinafter. Plasma display device 1 employs a sub-field method for displaying a gray-scale, namely, one field period is divided into a plurality of sub-fields, and each one of discharge cells of respective sub-fields is controlled its light emission and non-light emission. The respective sub-fields include an initializing period, an addressing period, and a sustained period.

During the initializing period, initializing discharge takes place so that wall charges necessary for address discharge coming next are formed on the respective electrodes. There are two types of initialization, i.e. one is an entire initialization that generates the initializing discharge at all the discharge cells, and the other one is a selective initialization that generates initializing discharge at the discharge cells where sustain discharge has taken place.

During the addressing period, address discharge takes place at the discharge cells to be illuminated, thereby forming the wall charges. During the sustained period, sustain pulses in the quantity proportional to luminance weight are applied to the display electrode pair alternately, so that sustain discharge takes place at the discharge cells where the address discharges have taken place. As a result, the discharge cells emit light. The proportionality constant in this case is referred to as "luminance magnification". A structure of the sub-field is detailed later, but a driving voltage waveform in the sub-field is demonstrated hereinafter together with its operation.

Figure 4:
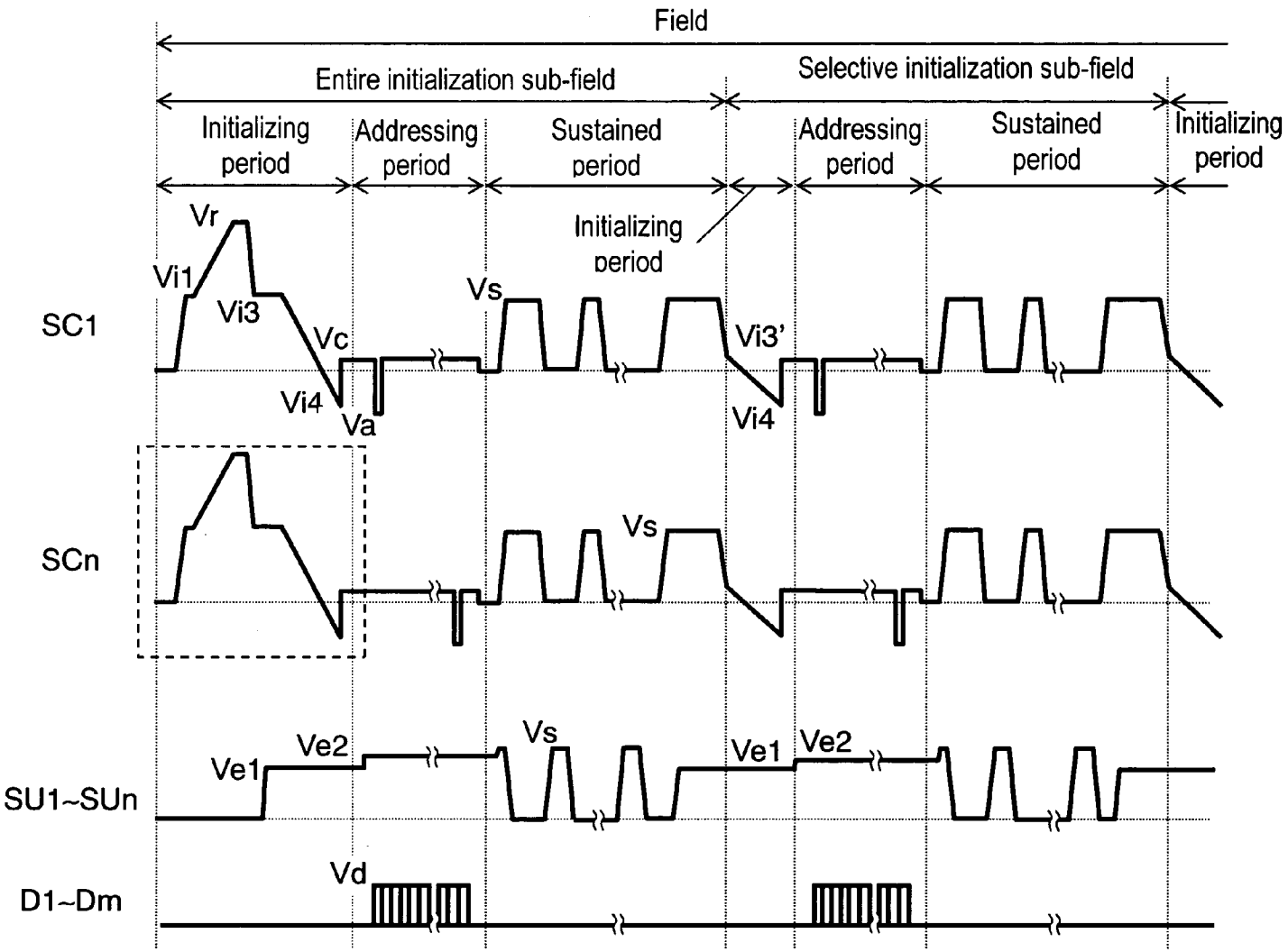
FIG. 4 shows a driving voltage waveform to be applied to respective electrodes of the panel in accordance with the first embodiment of the present invention.

FIG. 4 shows a driving voltage waveform to be applied to the respective electrodes of panel 10 in accordance with the first embodiment of the present invention. In FIG. 4, a sub-field where the entire initialization takes place and another sub-field where the selective initialization takes place are shown.

First, the sub-field where the entire initialization takes place is demonstrated hereinafter. In the first half of the initializing period, 0 (zero) V is applied to data electrodes D1-Dm and sustain electrodes SU1-SUn respectively, and a voltage shaped in inclined waveform is applied to scan electrodes SC1-SCn. This voltage in inclined waveform gently rises from voltage Vi1 not greater than a discharge start voltage with respect to sustain electrodes SU1-SUn to a voltage exceeding the discharge start voltage. The maximum voltage of the gently rising voltage applied to scan electrodes SC1-SCn during the first half of the initializing period is referred to as "initializing voltage Vr".

During the rise of this voltage in inclined waveform, faint initializing discharge takes place among scan electrodes SC1-SCn, sustain electrodes SU1-SUn, and data electrodes D1-Dm, so that negative wall voltages are stored in the upper sections of scan electrodes SC1-SCn, and positive wall voltages are stored in the upper sections of data electrodes D1-Dm and sustain electrodes SU1-SUn as well. The wall voltages stored in the upper sections of the electrodes indicate the voltages produced by the wall charges stored on the dielectric layer, protective layer, and phosphor layer which cover the electrodes.

During the initializing discharge, the wall charges are stored more than necessary by expecting that the wall charges will be optimized in the following second half of the initializing period. The wall charges thus stored more than necessary can be controlled by the initializing voltage Vr, which is not kept constant but is varied as necessary. The mechanism of varying voltage Vr is detailed later.

In the second half of the initializing period, positive voltage Ve1 is applied to sustain electrodes SU1-SUn, and a voltage shaped in inclined waveform is applied to scan electrodes SC1-SCn. This voltage in the inclined waveform gently lowers from voltage V13 not lower than a discharge start voltage with respect to sustain electrodes SU1-SUn to voltage Vi4 exceeding the discharge start voltage. This voltage in gently lowering waveform is referred to as "ramp voltage". During the application of the ramp voltage, faint initializing discharge takes place among scan electrodes SC1-SCn, sustain electrodes SU1-SUn, and data electrodes D1-Dm, so that negative wall voltages stored in the upper sections of scan electrodes SC1-SCn, and positive wall voltages stored in the upper sections of sustain electrodes SU1-SUn are weakened. The positive wall voltages stored in the upper sections of data electrodes D1-Dm are thus adjusted to a suitable value for the addressing operation. The entire initialization that carries out the initializing discharge to all the discharge cells is thus finished.

A magnitude of the discharge at this time depends on the excessive wall charges stored during the first half of the initializing period, therefore, if initializing voltage Vr is low and the initializing discharge during the first half is weak, the initializing discharge during the second half becomes weak. To the contrary, if initializing voltage Vr is high, the initializing discharges both in the first half and the second half becomes strong.

During the addressing period coming next, apply voltage Ve2 to sustain electrodes SU1-SUn, and apply voltage Vc to scan electrodes SC1-SCn.

Next, apply negative scan pulse voltage Va to scan electrode SC1 on the first line, and at the same time, apply positive address pulse voltage Vd to data electrode Dk (k=1–m) of the discharge cell to be illuminated on the first line. At this time, a voltage difference at the intersection of data electrode Dk and scan electrode SC1 becomes equal to a sum of a difference in voltages (Vd–Va) applied from the outside and a difference between a wall voltage on data electrode Dk and a wall voltage on scan electrode SC1, so that the voltage difference exceeds the discharge start voltage. Then address discharge takes place between data electrode Dk and scan electrode SC1 as well as between sustain electrode SU1 and scan electrode SC1, whereby positive wall voltage is stored on scan electrode SC1 and negative wall voltage is stored on sustain electrode SU1 as well as on data electrode Dk.

Address discharge thus takes place in the discharge cells to be illuminated on the first line, and the addressing operation is carried out, i.e. the wall voltage is stored on the respective electrodes. The voltage at the intersection of data electrodes D1-Dm, to which no address pulse voltage Vd is applied, and scan electrode SC1 does not exceed the initializing start voltage, so that no address discharge takes place. The address operation is repeated up to the discharge cells on the "n"th line before the addressing period is ended.

During the sustained period coming next, a power recovery circuit is used for the driving in order to save power. The driving voltage waveform is detailed later, but sustaining operation during this period is outlined hereinafter. First, apply positive sustain pulse voltage Vs to scan electrodes SC1-SCn, and at the same time, apply 0 (zero) volt to sustain electrodes SU1-SUn. Then in the discharge cells, in which address discharge has taken place during the previous addressing period, a voltage difference between scan electrode SCi and sustain electrode SUi becomes equal to a sum of sustain pulse voltage Vs and a difference between the wall voltage on scan electrode SCi and that on sustain electrode SUi. The voltage difference thus exceeds the discharge start voltage.

Then sustain discharge takes place between scan electrode SCi and sustain electrode SUi, and the ultraviolet ray is generated, so that phosphor layer 35 emits light. On scan electrode SCi, negative wall voltage is stored, and positive wall voltage is stored on sustain electrode SUi. On top of that, positive wall voltage is stored on data electrode Dk. In the discharge cells, in which no address discharge has taken place during the addressing period, no sustain discharge takes place, so that the wall voltage at the end of the initializing period can be maintained.

Next, apply 0 (zero) voltage to scan electrode SC1-SCn, and apply sustain pulse voltage Vs to sustain electrodes SU1-SUn. Then in the discharge cells, in which the sustain discharge has taken place, a voltage difference between sustain electrode SUi and scan electrode SCi exceeds the discharge start voltage, so that sustain discharge takes place again between sustain electrode SUi and scan electrode SCi. Thus negative wall voltage is stored on sustain electrode SUi, and positive wall voltage is stored on scan electrode SCi. From this onward, sustain pulses in quantity of luminance weight multiplied by luminance magnification are applied to scan electrodes SC1-SCn and sustain electrodes SU1-SUn alternately, thereby supplying a potential difference between electrodes of the display electrode pair. In the discharge cells, where address discharges have taken place during the addressing period, sustain discharges thus keep going.

At the end of the sustained period, a voltage difference in a narrow pulse width is supplied between scan electrodes SC1-SCn and sustain electrodes SU1-SUn, so that the wall voltages on scan electrode SCi and sustain electrode SUi can be adjusted while the positive wall voltage remains on data electrode Dk.

Next, operation in a sub-field, where a selective initialization takes place, is demonstrated hereinafter. During the initializing period where the selective initialization takes place, apply voltage Ve1 to sustain electrodes SU1-SUn, and apply 0 (zero) voltage to data electrodes D1-Dm, and apply a ramp voltage gently lowering from voltage Vi3' to voltage Vi4 to scan electrodes SC1-SCn.

Then faint initializing discharge takes place in the discharge cells in which sustain discharge has taken place in the previous sub-field during the sustained period, so that wall voltages on scan electrode SCi and sustain electrode SUi are weakened. Data electrode Dk has stored enough positive wall voltage due to the sustain discharge generated immediately before, so that the excessive portion of the stored wall voltage is discharged for adjusting the wall voltage to be a suitable value for the addressing operation.

On the other hand, in the discharge cells of the previous sub-field, in which cells no sustain discharge has taken place, no discharge takes place, so that the wall charges at the end of initializing period of the previous sub-field can be maintained. The selective initialization thus carries out the initializing discharge to the selected discharge cells in which sustaining operation takes place during the sustained period of the immediate previous sub-field.

During the addressing period coming next, the operation is similar to that done during the addressing period in the sub-field where the entire initialization has taken place, so that the description thereof is omitted here. The operation in the sustained period coming next is also similar to that in the entire initialization sub-field except the number of sustain pulses.

Next, a structure of a sub-field to be used in a panel driving method in accordance with the first embodiment of the present invention is described hereinafter. One field is divided into 10 (ten) sub-fields, namely, first sub-field (1SF), second sub-field (2SF), third sub-field (3SF), , , , tenth sub-field (10SF). Each one of the sub-fields has a luminance weight (1, 2, 3, 6, 11, 18, 30, 44, 60, 80). The first embodiment is described based on the foregoing two assumptions; however, the number of sub-fields and the luminance weight are not limited to the foregoing instances.

Figure 5A:
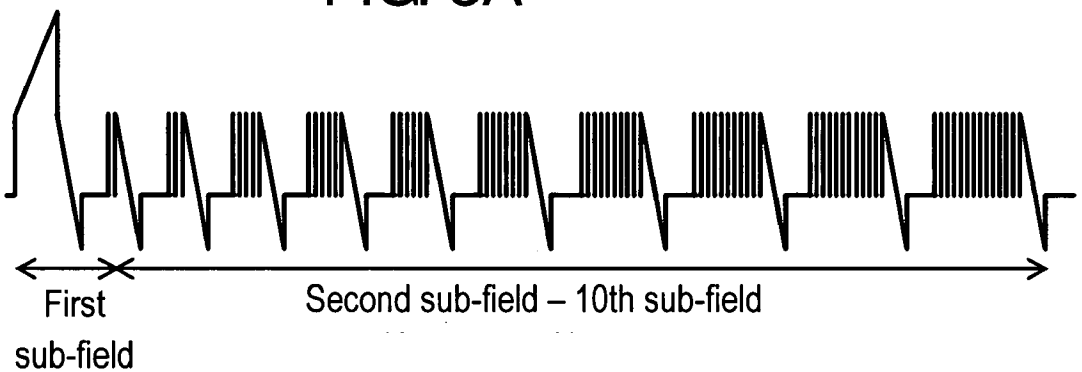
FIG. 5A schematically shows a sub-field structure in accordance with the first embodiment of the present invention.
Figure 5B:
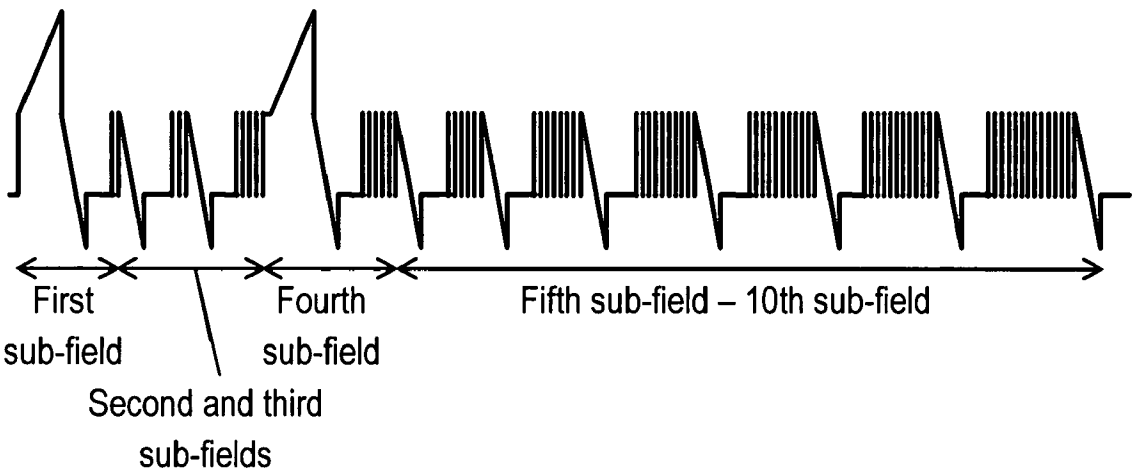
FIG. 5B schematically shows a sub-field structure in accordance with the first embodiment of the present invention.

FIGS. 5A and 5B schematically describe structures of a sub-field in accordance with the first embodiment. Each one of the sub-fields is either one of an entire initialization sub-field where all the cells are initialized during the initializing period, or a selective initialization sub-field where cells are selectively initialized. FIGS. 5A, 5B, FIGS. 6A-6E, FIGS. 7A-7E, FIGS. 14A-14E, and FIGS. 15A-15D schematically illustrate a panel driving waveform in one field. FIG. 4 shows waveforms in more detail, namely, the waveforms during the respective periods in respective sub-fields.

In this first embodiment, the sub-field structure is switched to another one based on APL of a video signal to be displayed. FIG. 5A shows a structure to be used when the video signal has APL lower than 6%, in which structure only the first sub-field is the entire initialization sub-field, and the second sub-field - the 10th sub-field are the selective initialization sub-fields. FIG. 5B shows another structure to be used when the video signal has APL not lower than 6%, in which structure the first and the fourth sub-fields are the entire initialization sub-fields, and the second, the third, the fourth sub-fields, and the fifth - the 10th sub-fields are the selective initialization sub-fields. In other words, the sub-field structure is this: when APL is lower than the threshold value 6%, the entire initialization takes place once, and when APL is not lower than the threshold value 6%, the entire initialization takes place twice. The following table 1 shows a relation between the foregoing sub-field structure and APL.

TABLE 1

| APL | The number of entire initialization | The number of entire initialization sub-field |
|---|---|---|
| Less than 6% | 1 | 1 |
| Not less than 6% | 2 | 1, 4 |

However, variation simply in the number of the entire initializations will change the luminance of black-display area, namely, the black luminance, which should be kept constant, so that picture quality is lowered. In the case of varying the number of the entire initializations depending on APL, the variation is carried out not only in the number of the entire initializations, but also initializing voltage Vr to be applied to scan electrodes 22 is varied step by step for moderating a sharp change in the black luminance while the number of the entire initializations can be varied. The control over initializing voltage Vr thus allows moderating the variation in the black luminance while the number of the entire initializations is varied.

FIGS. 6A-6E schematically show variations in initializing voltage Vr applied to scan electrode 22 during the initializing period of the plasma display device in accordance with the first embodiment of the present invention. To be more specific, FIGS. 6A-6E illustrate chronological changes in the driving waveform when the number of sub-fields including an entire initialization is increased from one to two. In this example, the changes of initializing voltage Vr take place in the first sub-field and the fourth sub-field, and the changes are shown schematically in FIGS. 6A-6E. Voltage value VrC indicates a set value of initializing voltage Vr in the case of no change taking place in the number of the entire initializations. Voltage values VrL and VrH indicate the min. value and the max. value of initializing voltage Vr in the case of changes taking place in the number of the entire initializations.

Figures 6A, 6B, 6C, 6D, 6E:
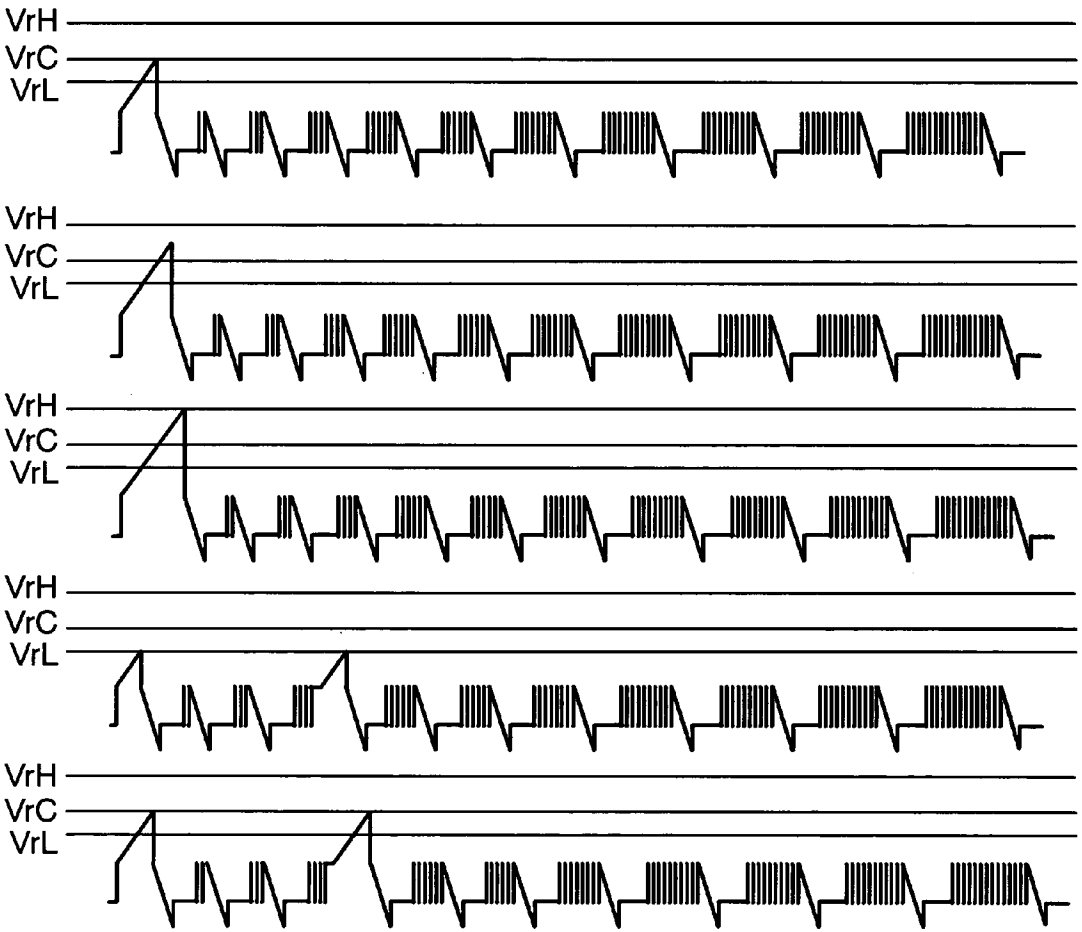
FIG. 6A schematically shows a variation in an initializing voltage of the plasma display device in accordance with the first embodiment of the present invention.
FIG. 6B schematically shows a variation in an initializing voltage of the plasma display device in accordance with the first embodiment of the present invention.
FIG. 6C schematically shows a variation in an initializing voltage of the plasma display device in accordance with the first embodiment of the present invention.
FIG. 6D schematically shows a variation in an initializing voltage of the plasma display device in accordance with the first embodiment of the present invention.
FIG. 6E schematically shows a variation in an initializing voltage of the plasma display device in accordance with the first embodiment of the present invention.

When the number of sub-fields, having an initializing period where the entire initialization takes place, is increased from one to two, initializing voltage Vr of the first sub-field is raised step by step from voltage VrC (the voltage prior to the increase) as shown in FIGS. 6A and 6B. Then voltage Vr reaches voltage VrH after a certain time as shown in FIG. 6C.

Next, as shown in FIG. 6D, the entire initialization takes place also in the fourth sub-field, and initializing voltage Vr in the first and the fourth sub-fields are set at voltage VrL lower than voltage VrC. Meanwhile voltages VrH and VrL are preferably set such that the black luminance values in the following two cases become approx. equal to each other: the black luminance during one field when the entire initialization takes place once, and initializing voltage Vr=voltage VrH; and the other black luminance during one field when the entire initialization takes place twice, and initializing voltage Vr=voltage VrL. The foregoing setting of voltages VrH and VrL allows substantially equalizing the black luminance of the one field shown in FIG. 6C to the black luminance of the one field shown in FIG. 6D.

Then as shown in FIG. 6E, the value of initializing voltage Vr is raised step by step both in the first and the fourth sub-fields to the constant value of voltage VrC over a period of a given time.

To the contrary, when the number of the entire initializations is decreased from two to one, the value of initializing voltage Vr is lowered step by step from voltage VrC both in the first and the fourth sub-fields to voltage VrL over a period of a given time.

Then an initializing operation in the fourth sub-field is switched to the selective initialization, and the value of initializing voltage Vr in the first sub-field is set at voltage VrH higher than voltage VrC, and then the value of voltage Vr in the first sub-field is lowered from voltage VrH step by step to voltage VrC over a period of a given time.

In the case of varying the number of sub-fields, having an initializing period in which the entire initialization takes place, in one field in response to APL of a video signal to be displayed, a control over initializing voltage Vr applied to scan electrode 22 during the entire initialization period allows substantially equalizing the black luminance of the field immediately before the field, where the number of entire initializations is changed, to the black luminance of the field immediately after the field where the number of entire initializations has been changed. As a result, changes in the luminance of light emission due to the entire initialization can be moderated, and variation of the black luminance can be inconspicuous, so that the picture quality is improved.

In this first embodiment, a threshold value is set at 6% with respect to APL, and the number of the entire initializations carried out based on APL in one field is one or two. However, the present invention is not limited to the foregoing instances, and the threshold value or the number of the entire initializations can be set in response to the characteristics of the panel or videos to be displayed.

Exemplary Embodiment 2

FIGS. 7A-7E schematically show variations in initializing voltage Vr when the number of entire initializations in one field is increased from two to three in response to APL of a video signal to be displayed on the plasma display device in accordance with the second embodiment of the present invention. FIGS. 7A-7E show that the entire initialization takes place in the sixth sub-field in addition to the first and the fourth sub-fields.

Figures 7A, 7B, 7C, 7D, 7E:
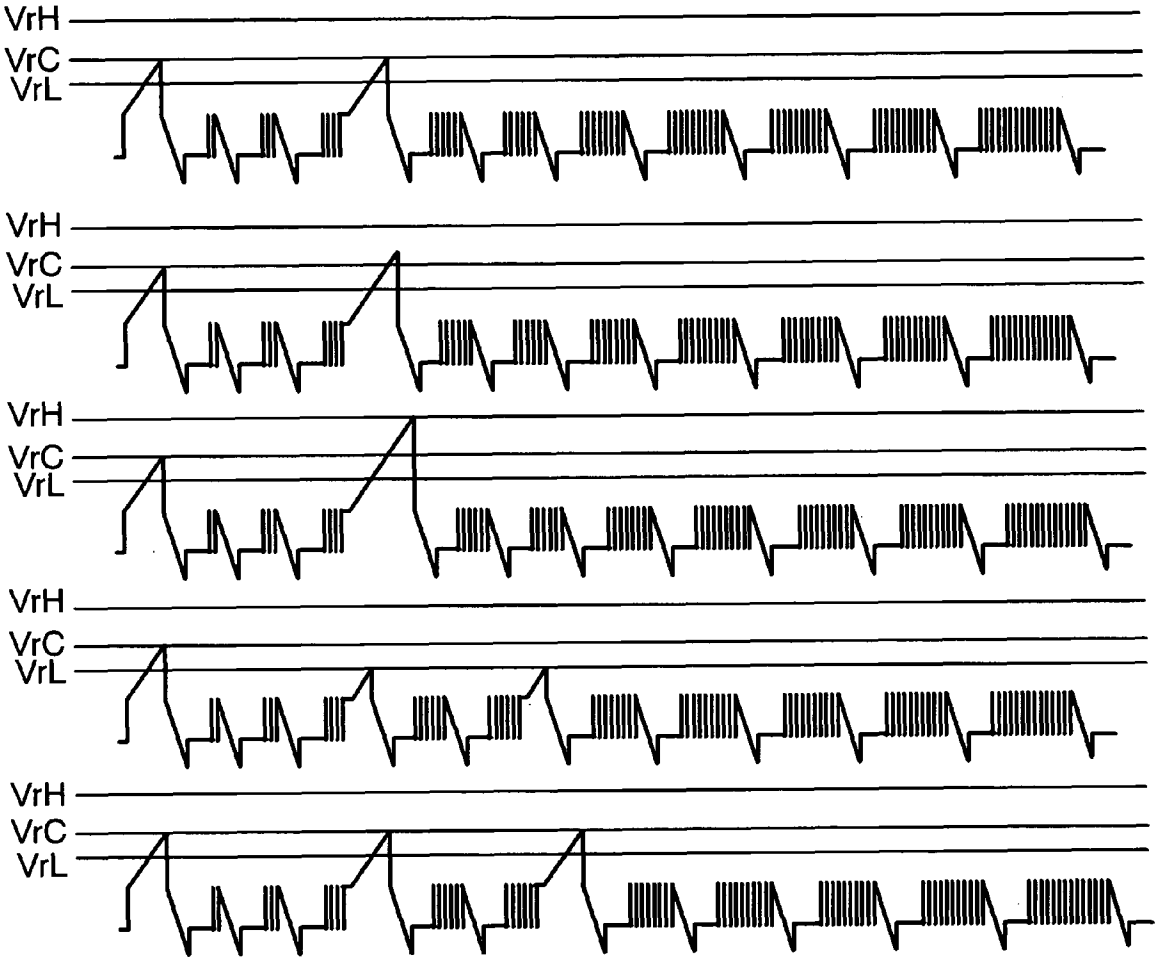
FIG. 7A schematically shows a variation in an initializing voltage of a plasma display device in accordance with a second embodiment of the present invention.
FIG. 7B schematically shows a variation in an initializing voltage of the plasma display device in accordance with the second embodiment of the present invention.
FIG. 7C schematically shows a variation in an initializing voltage of the plasma display device in accordance with the second embodiment of the present invention.
FIG. 7D schematically shows a variation in an initializing voltage of the plasma display device in accordance with the second embodiment of the present invention.
FIG. 7E schematically shows a variation in an initializing voltage of the plasma display device in accordance with the second embodiment of the present invention.

When the number of entire initializations is increased from two to three, initializing voltage Vr in the fourth sub-field is raised step by step from voltage VrC (before the increase) to voltage VrH as shown in FIG. 7C over a period of a given time while initializing voltage Vr in the first sub-field is kept at voltage VrC as shown in FIGS. 7A and 7B.

Next, as shown in FIG. 7D, the entire initialization is carried out not only in the first and the fourth sub-fields but also in the sixth sub-field, and initializing voltages Vr in the fourth and the sixth sub-fields are set at voltage VrL lower than VrC while initializing voltage Vr in the first sub-field is kept at VrC.

In this second embodiment, initializing voltage Vr in the first sub-field is kept at voltage VrC; however, it can be varied within a range in which the black luminance can stay inconspicuous.

In this instance, values of voltages VrH and VrL are set such that the following two values of black luminance become equal to each other: one black luminance is measured when two entire initializations take place and initializing voltage Vr in the first sub-field takes a value of voltage VrC, and that in the fourth sub-field takes a value of voltage VrH; the other black luminance is measured when three entire initializations take place and initializing voltage Vr in the first sub-field takes a value of voltage VrC, and those in the fourth and the sixth sub-fields take a value of voltage VrL.

Then as shown in FIG. 7E, the value of initializing voltages Vr in the fourth and the sixth sub-fields are raised from voltage VrL step by step to voltage VrC over a period of a given time.

To the contrary, when the number of entire initializations in one field is reduced from three to two, the value of initializing voltage Vr is lowered from voltage VrC step by step both in the fourth and the sixth sub-fields to voltage VrL over a period of a given time while initializing voltage Vr in the first sub-field is kept at voltage VrC.

Next, the sixth sub-field is switched over to a selective initialization sub-field, and initializing voltage Vr in the fourth sub-field is set at voltage VrH higher than voltage VrC while voltage Vr in the first sub-field is kept at voltage VrC. Then voltage Vr in the fourth sub-field is lowered step by step from voltage VrH to voltage VrC over a period of a given time.

As discussed above, when the number of entire initializations in one field is three or more than three, they can be controlled in a similar way. In the foregoing description, initializing voltage Vr in the first sub-field is kept constantly; however, the initializing voltage of the respective entire initialization sub-fields can be set at a voltage that can prevent the black luminance from changing drastically between immediately before and immediately after the increase in the number of the entire initializations.

This second embodiment describes the process of variation in the entire initializing voltage when the number of entire initializations is increased from two to three in response to APL of a video signal. When the entire initialization takes place twice, initializing voltage Vr is set at voltage VrC, and when three entire initializations take place, initializing voltage Vr is also set at voltage VrC. However, the present invention is not limited to this instance, and these conditions can be set in response to the characteristics of a panel and videos to be displayed.

Exemplary Embodiment 3

This third embodiment tells that entire cell initializing voltage Vr takes values of the highest voltage VrH, the lowest voltage VrL, and voltages VrC2 and VrC3 between the highest one and the lowest one.

FIGS. 8A-8E schematically shows a variation in initializing voltage Vr when voltage Vr, i.e. voltage VrC3 in the case of three entire initializations is lower than voltage Vr, i.e. voltage VrC2 in the case of two entire initializations. In FIGS. 8A-8E, the sixth sub-field is changed to the entire initialization sub-field together with the first and the fourth sub-fields.

Figure 8A:
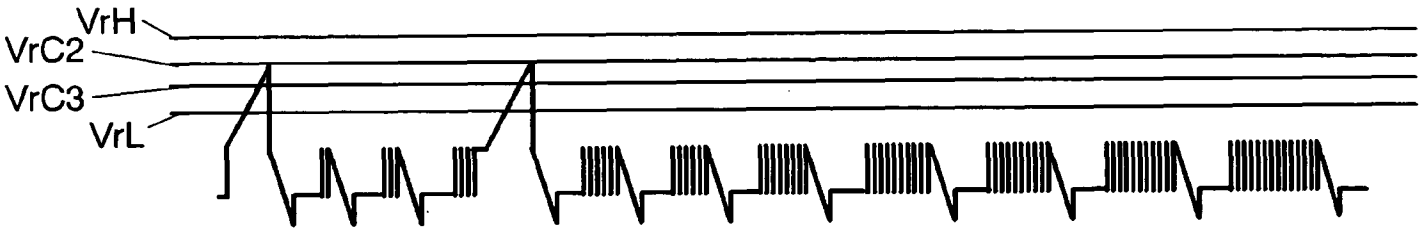
FIG. 8A schematically shows a variation in an initializing voltage of a plasma display device in accordance with a third embodiment of the present invention.
Figure 8B:
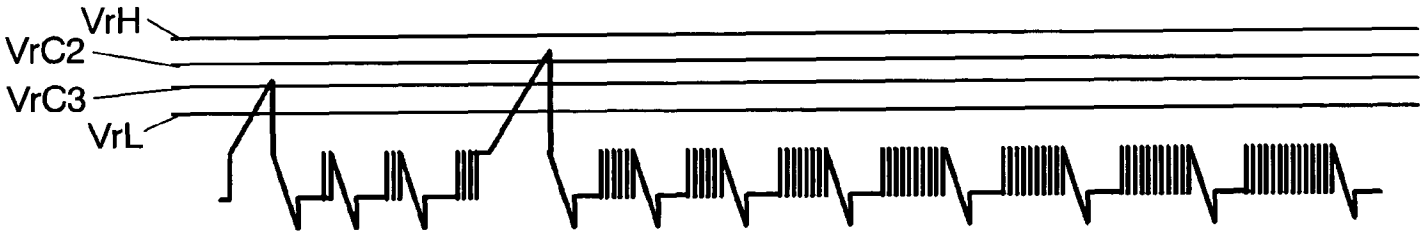
FIG. 8B schematically shows a variation in an initializing voltage of the plasma display device in accordance with the third embodiment of the present invention.
Figure 8C:
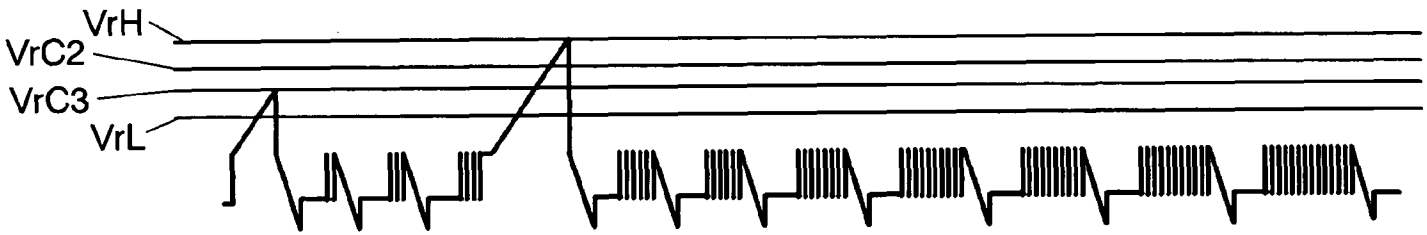
FIG. 8C schematically shows a variation in an initializing voltage of the plasma display device in accordance with the third embodiment of the present invention.

When the number of entire initializations is increased from two to three, initializing voltage Vr in the first sub-field is lowered step by step from voltage VrC2 (voltage before the increase) as shown in FIGS. 8A and 8B, and voltage Vr in the fourth sub-field is raised step by step from voltage VrC2 (voltage before the increase). Voltage Vr in the first sub-field reaches voltage VrC3, and voltage Vr in the fourth sub-field reaches VrH respectively over a given period as shown in FIG. 8C.

Figure 8D:
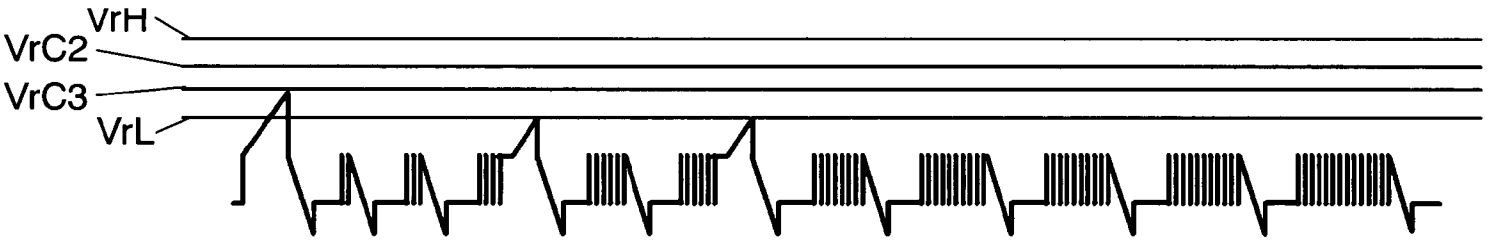
FIG. 8D schematically shows a variation in an initializing voltage of the plasma display device in accordance with the third embodiment of the present invention.

Next, as shown in FIG. 8D, the entire initialization is carried out not only in the first and the fourth sub-fields but also in the sixth sub-field, and initializing voltages Vr in the fourth and the sixth sub-fields are set at voltage VrL lower than voltage VrC3 while initializing voltage Vr in the first sub-field is kept at voltage VrC3.

In this third embodiment, initializing voltage Vr in the first sub-field is kept at voltage VrC; however, it can be varied within a range in which the black luminance can stay inconspicuous.

Figure 8E:
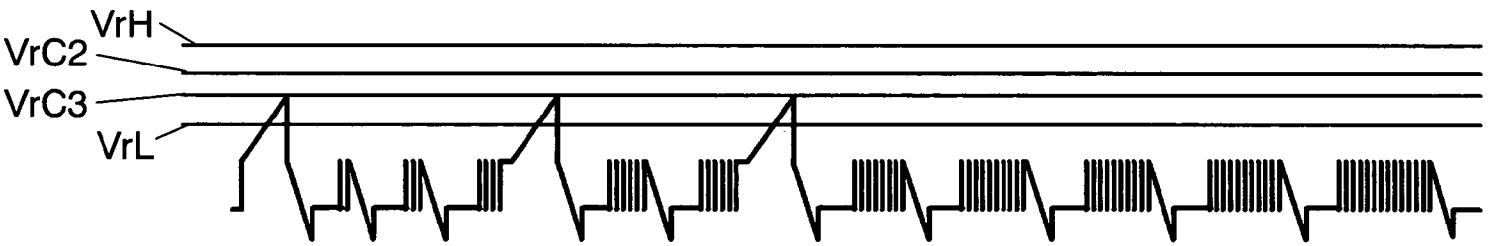
FIG. 8E schematically shows a variation in an initializing voltage of the plasma display device in accordance with the third embodiment of the present invention.

In this instance, values of voltages VrH and VrL are set such that the following two values of black luminance become equal to each other: one black luminance is measured when two entire initializations take place and initializing voltage Vr in the first sub-field is voltage VrC3, and that in the fourth sub-field is voltage VrH; the other black luminance is measured when three entire initializations take place and initializing voltage Vr in the first sub-field is voltage VrC3, and those in the fourth and the sixth sub-fields are voltage VrL. The black luminance of the field shown in FIG. 8C is substantially equal to that in the field shown in FIG. 8D. Then as shown in FIG. 8E, initializing voltages Vr in the fourth and the sixth sub-fields are raised step by step from voltage VrL to voltage VrC3 over a period of a given time.

To the contrary, when the number of entire initializations in one field is reduced from three to two, the value of initializing voltage Vr is lowered from voltage VrC3 step by step both in the fourth and the sixth sub-fields to voltage VrL over a period of a given time while initializing voltage Vr in the first sub-field is kept at voltage VrC3.

Next, the sixth sub-field is switched over to a selective initialization sub-field, and initializing voltage Vr in the fourth sub-field is set at voltage VrH higher than voltage VrC3 while voltage Vr in the first sub-field is kept at voltage VrC3. Then voltage Vr in the first sub-field is raised step by step, and voltage Vr in the fourth sub-field is lowered step by step from voltage VrH. Initializing voltage Vr in the first sub-field and that in the fourth sub-field reach voltage VrC2 over a period of a given time.

As discussed above, even if initializing voltage Vr, which is set expecting the case where no change occurs in the number of initializations, changes in response to the number of initializations, the initializing voltage of the respective entire initialization sub-fields can be set at a voltage that can prevent the black luminance from changing drastically between immediately before and immediately after the increase in the number of the entire initializations.

To be more specific, the initializing voltage of at least one sub-field among the entire initialization sub-fields in one field immediately before the field, in which the number of entire initialization sub-fields is increased, is set at a voltage higher than the initializing voltages of at least two sub-fields among the entire initialization sub-fields in one field immediately after the field in which the number of entire initialization sub-fields has been increased. On the other hand, the initializing voltage of at least two sub-fields among the entire initialization sub-fields in one field immediately before the field, in which the number of entire initialization sub-fields is decreased, is set at a voltage lower than the initializing voltage of at least one sub-field among the entire initialization sub-fields in one field immediately after the field in which the number of entire initialization sub-fields has been decreased.

During the process of changing the number of the entire initializations in one field, if APL of a video signal changes again, a halt of the process possibly invites discontinuous variation in the black luminance, and this variation affects the operation adversely. It is thus preferable that an introduction of another changing process is prohibited until the process of changing the number of entire initializations in one field is finished.

For instance, if the number of entire initializations needs to increase from one to three due to APL of a video signal to be displayed, the number of entire initializations in one field can be changed from one to two, and then the number can be changed from two to three.

As discussed above, in response to the characteristics of a panel or a vide to be displayed, or in order to control the black luminance, voltage VrC2 set for the case where the entire initialization takes place twice can be different from voltage VrC3 set for the case where the entire initialization takes place three times.

Exemplary Embodiment 4

Figure 9:
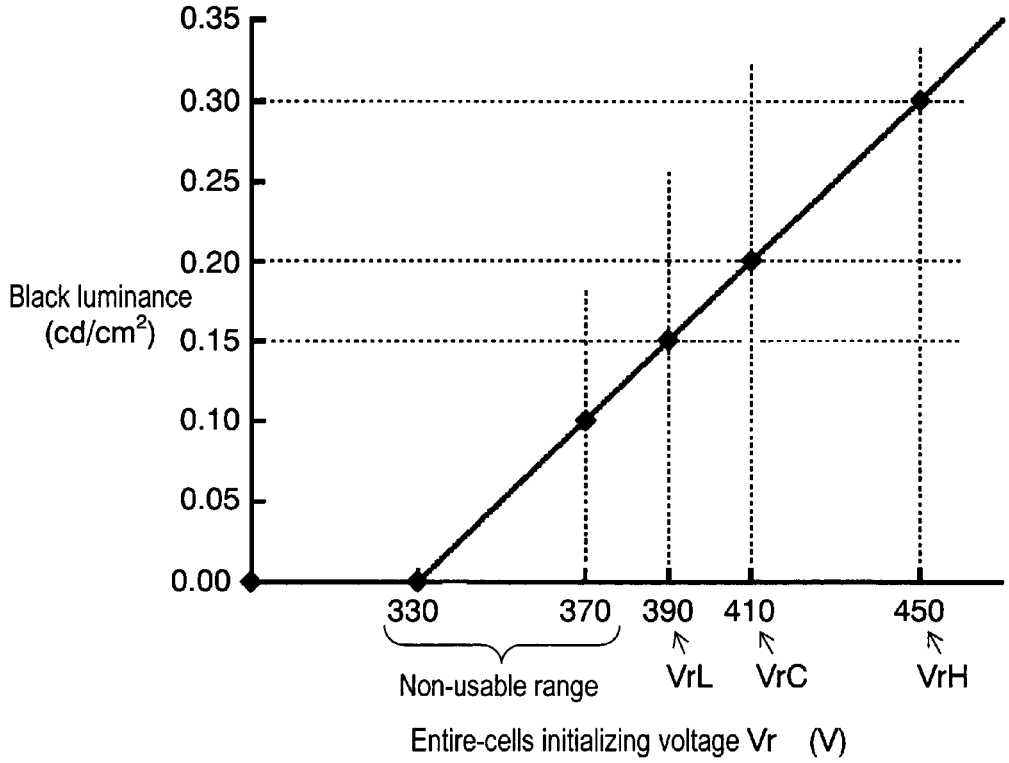
FIG. 9 shows a relation between an initializing voltage per entire initialization of the plasma display device in accordance with a fourth embodiment of the present invention.

A method of setting voltages VrL and VrH in the case of changing the number of entire initializations in one field is demonstrated hereinafter. FIG. 9 shows a relation between initializing voltage Vr when the entire initialization takes place once in one field vs. the black luminance at this entire initialization of the plasma display device in accordance with the fourth embodiment of the present invention. In this instance, when voltage Vr is not higher than 330V, no discharge takes place in the panel, so that the black luminance stays 0cd/cm$^2$. The initialization at this time becomes substantially equal to a selective initialization.

When voltage Vr is not lower than 330V, the black luminance increases at a rate of 0.05cd/cm$^2$ every time voltage Vr rises by 20V. Thus when initializing voltage Vr reaches 370V, the black luminance becomes 0.1cd/cm$^2$, and when initializing voltage Vr reaches 390V, the black luminance becomes 0.15cd/cm$^2$, and when initializing Voltage Vr reaches 410V, the black luminance becomes 0.2cd/cm$^2$, when initializing voltage Vr reaches 450V, the black luminance becomes 0.3cd/cm$^2$.

As discussed above, the black luminance rises at the greater initializing voltage Vr; however, within the range where voltage Vr stays between 330V and 370V, it is proved that an abnormal discharge takes place at an entire initialization. For instance, when an abnormal discharge happens in a discharge cell, abnormal wall charges are stored in this discharge cell, and an erroneous discharge phenomenon (hereinafter referred to as "abnormal initialization") happens, i.e. a sustain discharge happens in a sustained period, regardless of the presence of an address discharge. This phenomenon lowers the picture quality drastically. It is thus preferable not to set initializing voltage Vr at a value possibly inviting the abnormal initialization.

Voltages VrL and VrH are set such that those values can suppress discontinuous variations in the black luminance while those values will not fall in a range which possibly invites the abnormal initialization. This fourth embodiment takes notice of the fact that the black luminance stays at 0.15cd/cm$^2$ when initializing voltage Vr is 390V, and the black luminance becomes twice as much, namely 0.3cd/cm$^2$ when voltage Vr is 450V. Then voltage VrH is set at 450V, and voltage VrL at 390V, and voltage VrC during the entire initializing operation in stationary state is set at 410V.

The setting discussed above allows equalizing the values of the black luminance in the two cases described below, so that the black luminance at the changing of the number of entire initializations in one field can be varied continuously. The two cases discussed above are these: one black luminance is 0.3cd/cm$^2$ when the number of entire initializations is changed from one to two, and the other one is 0.3cd/cm$^2$ (0.15+0.15) when initializing voltages Vr in the first and the fourth sub-fields stay at voltages VrL. As a result, variations in the black luminance become inconspicuous, so that the picture quality can be improved.

In this fourth embodiment, voltage VrC in the stationary state is set at a value between voltages VrL and VrH, so that when the number of entire initializations in one field is increased from one to two as described in the first embodiment, initializing voltage Vr in the first sub-field is raised from VrC (410V) to VrH (450V). Then in the first and the fourth sub-fields, where initializing voltage Vr is set at voltage VrL (390V), the number of entire initializations is increased from one to two. After that, initializing voltage Vr in the first and the fourth sub-fields is raised from VrL (390V) to VrC (410V).

The present invention, however, is not limited to the driving method discussed above, the method of the present invention can also control initializing voltage Vr such that drastic variations in the black luminance can be moderated when the number of entire initializations in one field is changed. For instance, when initializing voltage Vr in the stationary state is set at voltage VrL=390V, and when the number of entire initializations in one field is increased from one to two, initializing voltage Vr in the first sub-field can be raised step by step from voltage VrL to voltage VrH, and then initializing voltage Vr in the first and the fourth sub-fields can be set at voltage VrL and the number of initializations is increased from one to two.

When voltage VrC is set at VrH=450V in the stationary state, and when the number of entire initializations is increased from one to two, the number of initializations can be increased from one to two while initializing voltage Vr in the first sub-field is kept at voltage VrL, and then initializing voltage Vr in the first and the fourth sub-fields can be raised step by step from voltage VrL to voltage VrH. In the case of decreasing the number of entire initializations in one field, a process similar to what is discussed above can be taken.

The control over initializing voltage Vr in a similar way to the foregoing one allows varying the black luminance continuously even when the number of entire initializations in one field is increased from two to three, or more than three.

As discussed above, among the consecutive fields before the field in which the number of entire initializations in one field is increased, an initializing voltage of at least one of entire initialization sub-fields can be raised step by step, and among the consecutive fields after the field in which the number of entire initializations has been decreased, an initializing voltage of at least one of entire initialization sub-fields can be lowered step by step.

Here is another way: among the consecutive fields after field in which the number of entire initializations in one field has been increased, initializing voltages of at least two of entire initialization sub-fields can be raised step by step, and among the consecutive fields before the field in which the number of entire initializations is decreased, initializing voltages of at least two of entire initialization sub-fields can be lowered step by step.

Voltages VrL, VrH, and VrC to be applied to scan electrode 22 during the entire initializing period are not limited to the foregoing embodiment, and it is preferable that they can be set optimally in response to the characteristics of a panel.

Exemplary Embodiment 5

This fifth embodiment describes a time needed for raising or lowering an initializing voltage to a given voltage when the number of entire initialization sub-fields is increased or decreased by one. This lapse of time needed for changing the initializing voltage is simply referred to "change time" hereinafter. In this fifth embodiment, assume that initializing voltage Vr varies at a speed of 2.5V/field, and the change time is approx. 0.4 second.

To be more specific, when the number of entire initializations is changed from one to two, it takes 16 fields or approx. 0.27 second for raising initializing voltage Vr in the first sub-field from voltage VrC=410V to voltage VrH=450V. It takes also 8 fields or approx. 0.13 second for raising initializing voltages Vr of the first and the fourth sub-fields from VrL=390V to VrC=410V. Thus the total change time is 0.40 second.

An excessively shorter change time will make the black luminance so conspicuous that the picture quality is lowered as discussed previously; however, an excessively longer change time is not preferable because it gives eyesight something wrong. This something wrong to the eyesight seems caused by discontinuous variations in a light emission cycle accompanying the entire initialization when the number of initializations is changed.

Figure 10:
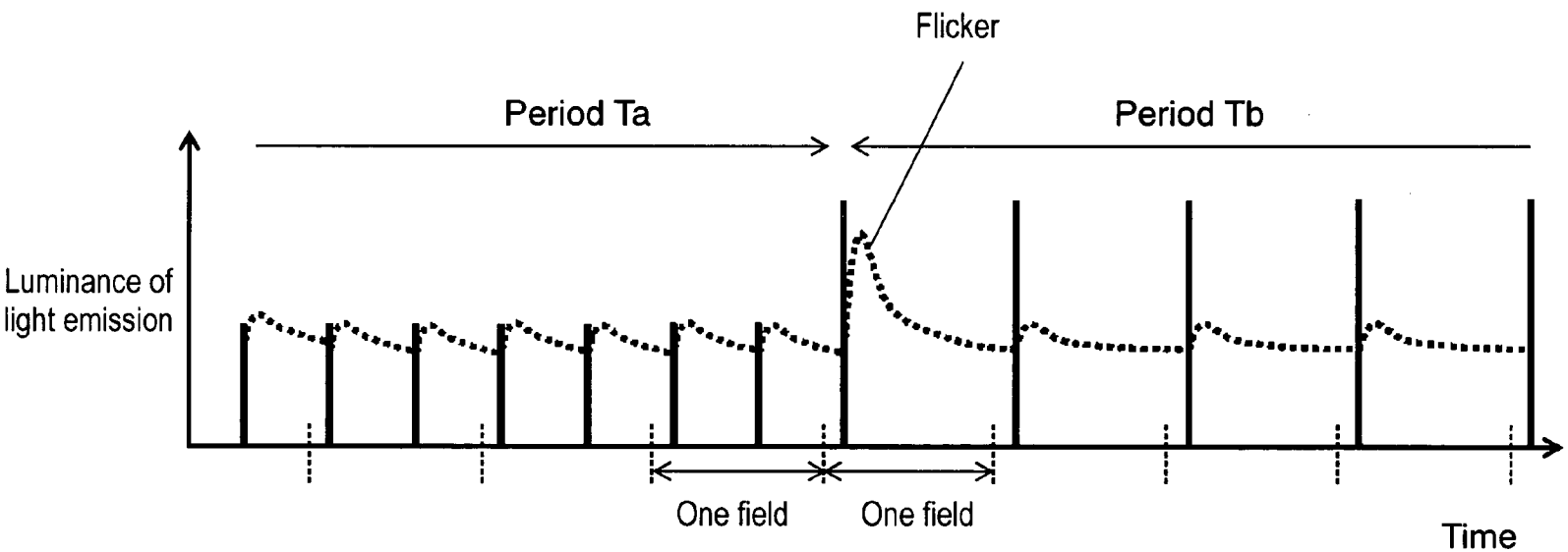
FIG. 10 schematically illustrates a reason why a variation in the number of initializations of a plasma display device in accordance with a fifth embodiment of the present invention gives user's eyesight a feeling of something wrong.

FIG. 10 schematically illustrates a reason why a variation in the number of initializations of a plasma display device in accordance with the fifth embodiment of the present invention gives user's eyesight a feeling of something wrong. The solid lines in FIG. 10 schematically indicate the light-emission luminance due to the initialization, and the broken lines indicate light intensity received by human eyes. Period Ta indicates a period of two entire initializations in one field, and period Tb indicates a period of one entire initialization in one field. For instance, as shown in FIG. 10, when the number of entire initializations is changed from two to one, initializing voltages Vr before this change in both the first and the fourth sub-field are voltage VrL=390V, and light emission occurs at a cycle of twice every one field. Human eyes recognize this cyclic light emission as an integrated one, so that the human eyes feel the black luminance at constant light intensity, i.e. 0.15cd/cm$^2$. After the change in the number, initializing voltage Vr in the first sub-field is voltage VrH=450V, and light emission takes place at a cycle of once every one field, and the human eyes recognize this cyclic light emission as an integrated one, so that the human eyes feel the black luminance also at light intensity 0.15cd/cm$^2$.

When the number of entire initializations in one field is changed from two to one, and at the moment when the cycle of light emission is broken, the human eyes recognize a change in the cycle, and it seems that the black luminance rises momentarily. This momentary rise in the black luminance is recognized as flicker, and the picture quality is thus lowered.

The present inventors have researched on the relation between the change time and the feeling of something wrong to eyesight. FIG. 11 shows an evaluation on the allowance about the variations in flicker and black luminance with respect to the change time of the plasma display device in accordance with the fifth embodiment of the present invention.

The relation of trade-off exists between flicker and variation in black luminance, i.e. a longer change time moderates variations in the black luminance but makes the flicker conspicuous, and to the contrary, a shorter change time makes the flicker inconspicuous but makes the variations in the black luminance conspicuous. As shown in FIG. 11, the change time is preferably set in the range between not shorter than 0.2 second and not longer than 1.6 seconds in order to make the flicker inconspicuous and suppress the variation in the black luminance to a certain extent. More preferably, the change time is set in the range between not shorter than 0.2 second and not longer than 0.8 second. In this fifth embodiment, the change time is set at 0.4 second based on this result.

Exemplary Embodiment 6

Figure 12:
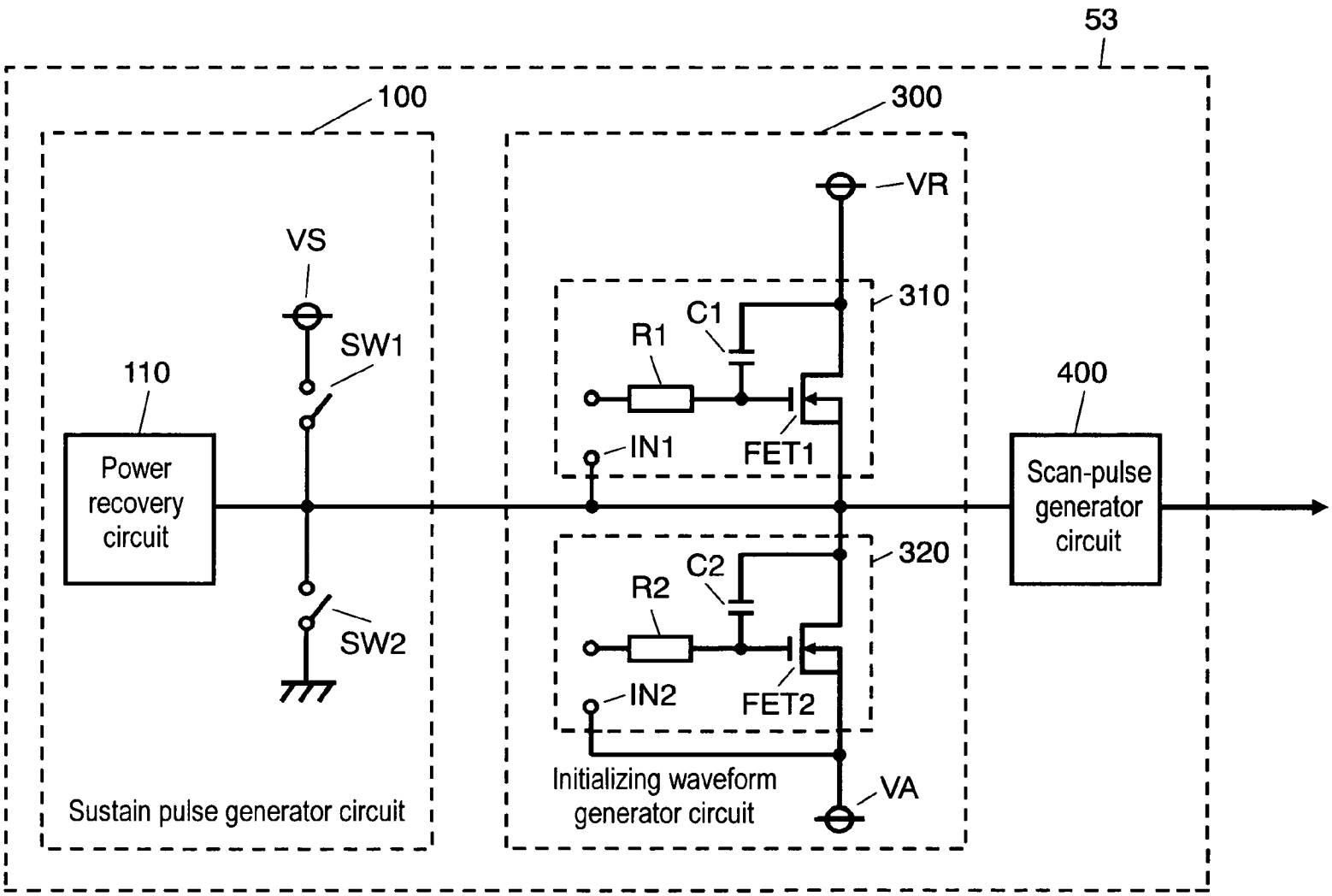
FIG. 12 shows a circuit diagram of a scan-electrode driving circuit of a plasma display device in accordance with a sixth embodiment of the present invention.

A method of controlling initializing voltage Vr at an entire initialization is described hereinafter. FIG. 12 shows a circuit diagram of scan electrode driving circuit 53 of a plasma display device in accordance with the sixth embodiment of the present invention. As shown in FIG. 12, driving circuit 53 comprises sustain-pulse generator circuit 100, initializing-waveform generator circuit 300, and scan-pulse generator circuit 400.

Sustain-pulse generator circuit 100 includes the following elements:

- power recovery circuit 110 for recovering the power used for driving scan electrode 22 in order to reuse the power;
- switching element SW1 for clamping scan electrode 22 at voltage Vs; and
- switching element SW2 for clamping scan electrode 22 at 0 (zero) volt.

Scan-pulse generator circuit 400 sequentially applies scan pulses to scan electrodes 22 during an addressing period. Circuit 400 outputs the voltage waveform of sustain-pulse generator circuit 100 or initializing waveform generator circuit 300 as it is during the initializing period and the sustained period.

Initializing waveform generator circuit 300 includes Miller integrator circuits 310 and 320, and circuit 300 generates the initializing waveform discussed above and controls initializing voltage Vr during the entire initialization. Miller integrator circuit 310 includes FET1, capacitor C1 and resistor R1, and generates a ramp voltage gently rising in a ramp shape to a give initializing voltage Vr. The other miller integrator circuit 320 includes FET2, capacitor C2 and resistor R2, and generates a ramp voltage gently lowering in a ramp shape to voltage Vi4. In FIG. 12, input terminals IN1 and IN2 are shown as the input terminals of Miller integrator circuits 310 and 320 respectively.

In this sixth embodiment, the Miller integrator circuits employing FETs, which are practical and simply constructed, are used as integrating waveform generator circuit 300; however, circuit 300 is not limited to this structure, and any circuit can be used as circuit 300 as far as it can generate a ramp voltage while it controls initializing voltage Vr.

Figure 13:
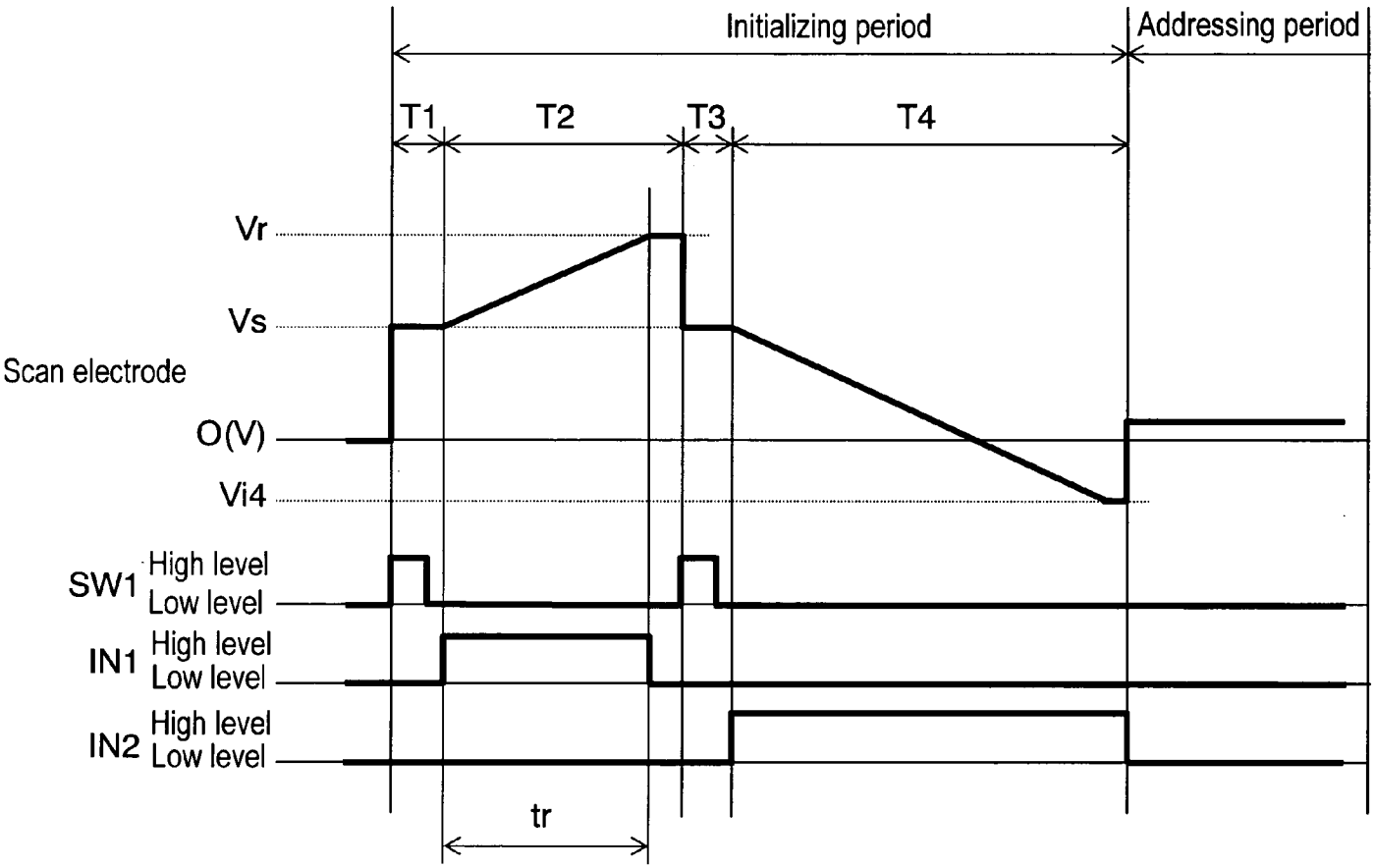
FIG. 13 shows a timing chart illustrating the operation of the scan-electrode driving circuit in accordance with a sixth embodiment of the present invention.

Next, operation of initializing waveform generator 300 is described hereinafter. FIG. 13 shows a timing chart illustrating the operation of scan-electrode driving circuit 53 in accordance with the sixth embodiment of the present invention. This timing chart details the section surrounded with broken lines in FIG. 4. The driving voltage waveform carrying out an entire initialization is divided into four periods, i.e. T1-T4, which are individually described here, and assume that voltages Vi1 and Vi3 are equal to voltage Vs. Action of making the switching element conductive is referred to as "turn on" and action of making the switching element cut-off is referred to as "turn off" in this description.

Period T1

First, turn on switching element SW1 of sustain-pulse generator circuit 100, then voltage Vs is applied to scan electrode 22 via switching element SW1, and then turn off switching element SW1.

Period T2

Next, turn input terminal IN1 of Miller integrator circuit 310 to "high level". To be more specific, apply e.g. 15V to input terminal IN1, then a given current runs from resistor R1 to capacitor C1. The source voltage of FET1 rises in a ramp shape, and an output voltage from scan-electrode driving circuit 53 starts rising in a ramp shape as well.

The source voltage keeps rising while input terminal IN1 stays at "high level". When the output voltage reaches necessary initializing voltage Vr, input terminal IN1 is turned to "low level". As discussed above, the ramp voltage, gently rising from voltage Vs not higher than the discharge start voltage to initializing voltage Vr exceeding the discharge start voltage, is applied to scan electrode 22. At this time, a longer time "tr", during which input terminal IN1 stays at "high level", allows initializing voltage Vr to be higher. A shorter time "tr" allows voltage Vr to be lower.

Period T3

Turn on switching element SW1 of sustain-pulse generator circuit 100, then the voltage of scan electrode 22 lowers to voltage Vs, and then turn off switching element SW1.

Period T4

Next, turn input terminal IN2 of Miller integrator circuit 320 to "high level". To be more specific, apply e.g. 15V to input terminal IN2, then a given current runs from resistor R2 to capacitor C2. The drain voltage of FET2 lowers in a ramp shape, and an output voltage from scan-electrode driving circuit 53 starts lowering in a ramp shape as well. The output voltage reaches negative voltage V14, then input terminal IN2 is turned to "low level". As discussed above, the ramp voltage, gently rising from voltage Vs to voltage Vi4, is applied to scan electrode 22.

The ramp voltage, gently rising from voltage Vs not higher than the discharge start voltage to initializing voltage Vr exceeding the discharge start voltage, is thus applied to scan electrode 22, then the ramp voltage gently lowering from voltage Vs to voltage V14 is applied to scan electrode 22.

The flicker accompanying the change of the number of initializations is generated this way: at the moment when light emission occurring twice per field is changed to once per field with doubled luminance, the recognition of this change in the luminance results in producing the flicker. In this sixth embodiment, the entire initialization takes place twice, i.e. once in the first sub-field and the other one takes place in the fourth sub-field, and there is a rather long time interval between these light emissions in one field, so that the difference from a light-emission occurring once tends to be conspicuous.

Thus when the number of entire initializations in one field is reduced from two to one, the following steps are taken: Firstly two initializations take place in, e.g. once in the first sub-field and the other one in the second sub-field, so that the light emissions in one field take place at a shorter time interval, and then the number of entire initializations in one field can be reduced. The following embodiment 7 describes the method of changing the number of entire initializations in one field based on this idea.

Exemplary Embodiment 7

A sub-field structure in accordance with the seventh embodiment is the same as that described in the first embodiment, namely, when APL is less than 6%, the first sub-field is the only entire initialization sub-field, and when APL is not less than 6%, the first and the fourth sub-fields are the entire initialization sub-fields.

FIGS. 14A-14F schematically show variations in initializing voltage Vr to be applied to scan electrode 22 during an initialization in accordance with the seventh embodiment of the present invention. These schematic drawings show the variations in the initializing waveform of each sub-field when the number of entire initializations is increased from one to two. In this seventh embodiment, voltage VrC indicates a set value of initializing voltage Vr when the number of entire initializations is not changed, and voltages VrL and VrH indicate the min. value and the max. value of initializing voltage Vr when the number of entire initializations is changed.

Figure 14A:
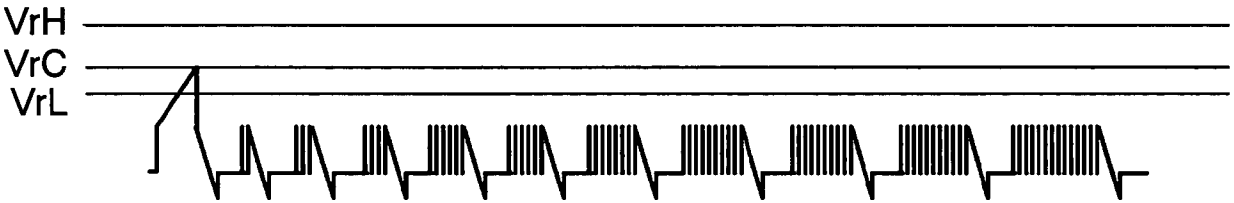
FIG. 14A schematically shows a variation in an initializing voltage of a plasma display device in accordance with a seventh embodiment of the present invention.
Figure 14B:
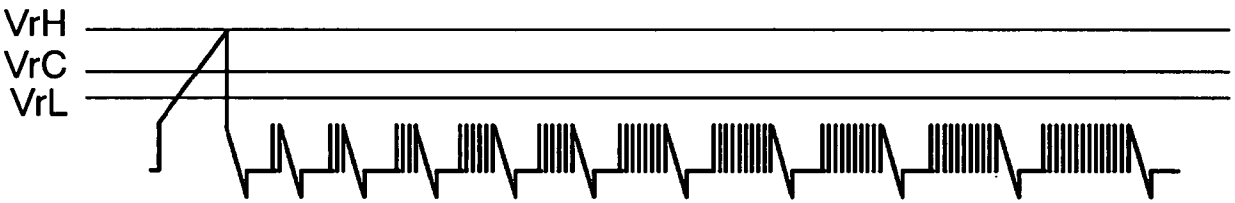
FIG. 14B schematically shows a variation in an initializing voltage of the plasma display device in accordance with the seventh embodiment of the present invention.

When the number of entire initializations in one field is increased from one to two, initializing voltage Vr to be used for initializing the entire cells is raised step by step from voltage VrC, the value before the number increment, to voltage VrH over a period of a given time, as shown in FIGS. 14A and 14B.

As discussed previously by using FIG. 13, for instance, time "tr" during which input terminal IN1 stays at "high level", is prolonged step by step in every one field, whereby initializing voltage Vr can be raised step by step in every one field sequentially.

Figure 14C:
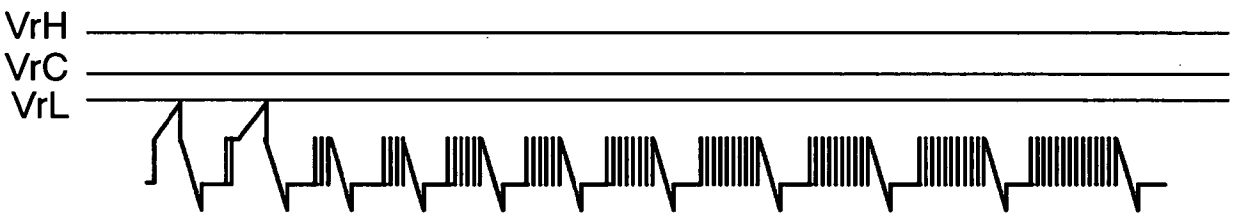
FIG. 14C schematically shows a variation in an initializing voltage of the plasma display device in accordance with the seventh embodiment of the present invention.

Next, as shown in FIG. 14C, the entire initialization takes place not only in the first sub-field but also in the second sub-field, and initializing voltages Vr in the first and the second sub-fields are set at voltage VrL lower than voltage VrC. Voltages VrL and VrH are set such that the values of black luminance in the following two cases become equal to each other as discussed in the first embodiment: the black luminance in one case: the entire initialization takes place once and initializing voltage Vr takes a value of VrH, the black luminance in the other case: the entire initialization takes place twice and voltage Vr takes a value of VrL.

Figures 14D, 14E, 14F:
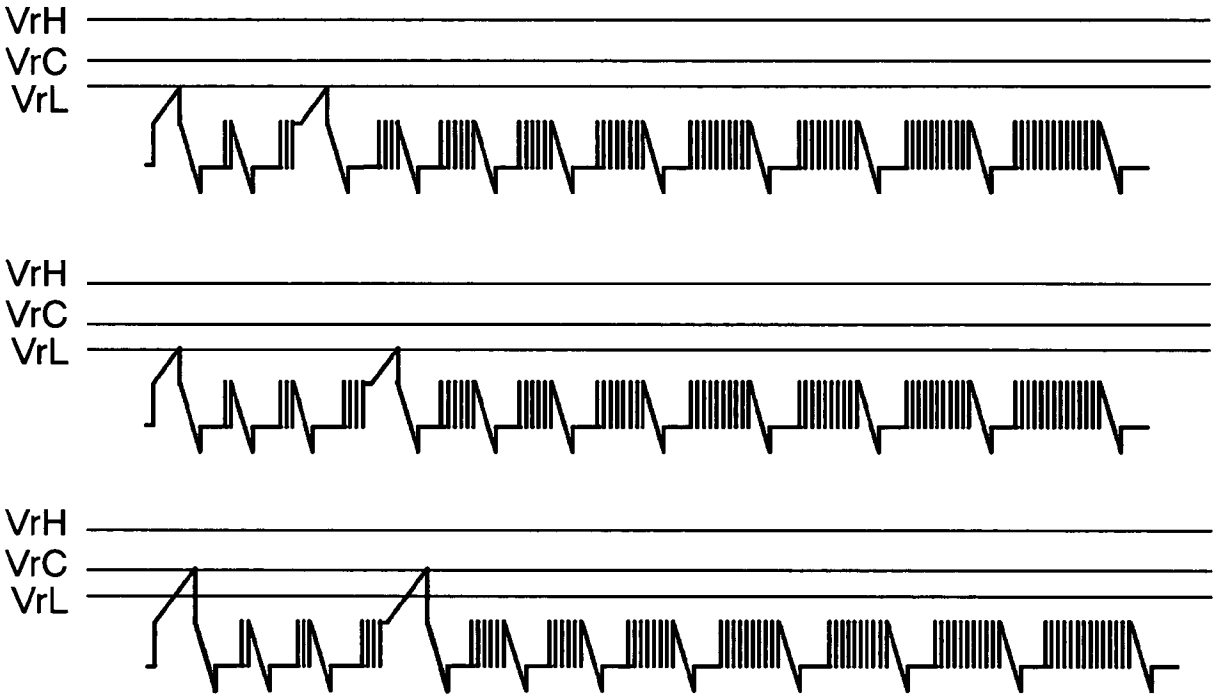
FIG. 14D schematically shows a variation in an initializing voltage of the plasma display device in accordance with the seventh embodiment of the present invention.
FIG. 14E schematically shows a variation in an initializing voltage of the plasma display device in accordance with the seventh embodiment of the present invention.
FIG. 14F schematically shows a variation in an initializing voltage of the plasma display device in accordance with the seventh embodiment of the present invention.

Then as shown in FIG. 14D, the second sub-field is switched over to a selective initialization sub-field, and the third sub-field is switched over to the entire initialization sub-field, and then as show in FIG. 14E, the third sub-field is switched over to the selective initialization sub-field, and the fourth sub-field is switched over to the entire initialization sub-field.

Then as shown in FIG. 14F, initializing voltages Vr in the first and the fourth sub-fields are raised step by step from voltage VrL to a stationary state of voltage Vr over a period of a given time. To the contrary, when the number of initializations is decreased from two to one, initializing voltages Vr in the first and the fourth sub-fields are lowered step by step from voltage VrC to voltage VrL. Next, the fourth sub-field is switched over to the selective initialization sub-field and the third sub-field is switched over to the entire initialization sub-field. Then the third one is switched over to the selective initialization sub-field, and the second one is switched over to the entire initialization sub-field. Then an initialization in the second sub-field is switched to the selective initialization, and initializing voltage Vr in the first sub-field is set at voltage VrH, and then this voltage Vr is lowered step by step from voltage VrH to voltage VrC.

As discussed above, the number of entire initializations is changed firstly in the sub-fields placed before and after the entire initialization sub-field, and then the initializing operation in respective sub-fields is switched over sequentially such that the sub-field in which the entire initialization is to take place can be moved to a given sub-field. This process allows changing the number of entire initializations free from producing flicker.

In other words, when the number of entire initialization sub-fields in one field is increased, the selective initialization sub-field placed immediately before or immediately after the sub-field, in which the entire initialization is to take place, is switched over to an entire initialization sub-field. When the number of entire initialization sub-fields is decreased, one of the entire initialization sub-fields placed consecutively is switched over to a selective initialization sub-field. On top of that, the entire initialization sub-fields are switched over to the selective initialization sub-fields or vice versa without changing the number of entire initialization sub-fields. When the sub-field, in which an entire initialization is to take place, is moved to a given sub-field, the entire initialization sub-field placed immediately before or immediately after the selective initialization sub-field can be switched over to the selective initialization sub-field, and the selective initialization sub-field placed immediately before or immediately after the entire initialization sub-field can be switched over to the entire initialization sub-field.

The foregoing description details the method of carrying out the following process: when the number of entire initialization is increased, the second sub-field placed immediately after the first sub-field is switched over to an entire initialization sub-field, and after this switchover, a sub-field in which an entire initialization is to take place is moved from the second sub-field to the fourth sub-field, then initializing voltage Vr reaches a given value.

However, initializing voltage Vr can reach the given value firstly, then the entire initialization sub-field can be moved to the given sub-field, or here is another method: voltage Vr reaches the given value while the entire initialization sub-field is moved to the given sub-field. These methods also produce a similar advantage to what is discussed above. In the case of decreasing the number of the entire initializations, similar methods are available.

When the number of entire initializations is changed from two or more than two entire initializations, firstly the number of entire initializations is changed in the sub-field placed immediately before or immediately after the entire initialization sub-field, then an initializing operation in respective sub-fields is switched over sequentially such that the sub-field, in which an entire initialization is carried out, can be moved to a given sub-field. This process allows changing the number of entire initializations free from producing flicker.

Exemplary Embodiment 8

A panel driving method in accordance with the eighth embodiment can suppress flicker accompanying the change in the number of initializations while this method drives the panel. Light emission luminance of the sub-field, in which the number of initializations is to be changed, is regulated to a lower level, thereby suppressing the flicker.

A sub-field structure in accordance with the eighth embodiment is the same as that described in the first embodiment, namely, when APL is less than 6%, the first sub-field is the only entire initialization sub-field, and when APL is not less than 6%, the first and the fourth sub-fields are the entire initialization sub-fields.

FIG. 15A-15D schematically show variations in initializing voltage Vr to be applied to scan electrode 22 during an initializing in accordance with the eighth embodiment of the present invention. These schematic drawings show the variations in the initializing waveform of each sub-field when the number of entire initializations is increased from one to two. In this eighth embodiment, assume that the relation shown in FIG. 9 is applied between the black luminance of the panel and initializing voltage Vr.

Figures 15A, 15B, 15C, 15D:
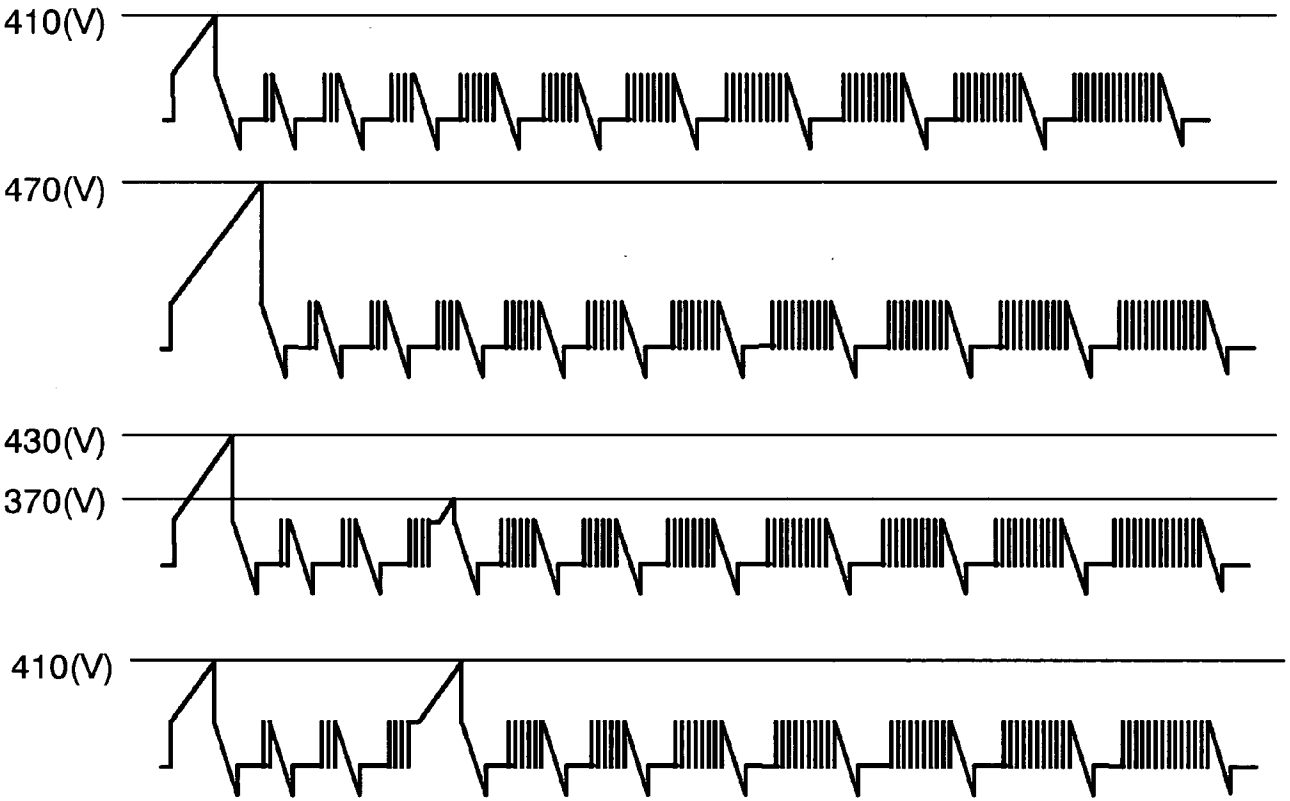
FIG. 15A schematically shows a variation in an initializing voltage of a plasma display device in accordance with an eighth embodiment of the present invention.
FIG. 15B schematically shows a variation in an initializing voltage of the plasma display device in accordance with the eighth embodiment of the present invention.
FIG. 15C schematically shows a variation in an initializing voltage of the plasma display device in accordance with the eighth embodiment of the present invention.
FIG. 15D schematically shows a variation in an initializing voltage of the plasma display device in accordance with the eighth embodiment of the present invention.

When the number of entire initializations in one field is increased from one to two, initializing voltage Vr to be used for initializing the entire cells is raised step by step from 410V, the value before the number increment, to 470V over a period of a given time, as shown in FIGS. 15A and 15B. Next, as shown in FIG. 15C, the entire initialization takes place not only in the first sub-field but also in the fourth sub-field. At this time initializing voltage Vr is, e.g. 430V in the first sub-field, and 370V in the fourth sub-field.

Initializing voltages Vr in respective sub-fields are set such that the sub-fields placed before and after the sub-field, in which the number of initializations is increased, have the values of black luminance equal to each other, and the black luminance of the fourth sub-field in this embodiment, i.e. the additional entire initialization sub-field, is lower than the black luminance of the first sub-field in this embodiment, i.e. the original entire initialization sub-field.

Actually as shown in FIG. 9, the black luminance of the first sub-field at initializing voltage Vr=470V is 0.35cd/cm$^2$, this luminance is a sum of the black luminance 0.25cd/cm$^2$ of the first sub-field at initializing voltage Vr=470V and the black luminance 0.10cd/cm$^2$ of the fourth sub-field at initializing voltage Vr=370V. The black luminance 0.10cd/cm$^2$ of the fourth sub-field is less than a half of the black luminance 0.25cd/cm$^2$ of the first sub-field.

Then as shown in FIG. 15D, initializing voltage Vr=430V in the first sub-field is lowered step by step to 410V, and initializing voltage Vr=370V in the fourth sub-field is raised step by step to 410V.

To the contrary, when the number of initializations is decreased from two to one, initializing voltage Vr=410V in the first sub-field is raised step by step to 430V, and initializing voltage Vr=410V in the fourth sub-field is lowered step by step to 370V. Next, the fourth sub-field is witched over to a selective initialization sub-field, and initializing voltage Vr in the first sub-field is set at 470V. At this time, voltage Vr is set such that the values of black luminance of the sub-fields before and after the sub-field, in which the number of initializations is reduced, become equal to each other, and the black luminance of the entire initialization sub-field immediately before the sub-field, which is newly switched over to the selective initialization sub-field, becomes lower than the black luminance of the entire initialization sub-field which is not to be switched over to the selected initialization sub-field. Then initializing voltage Vr=470V in the first sub-field is lowered step by step to 410V.

As discussed above, in a field immediately after the field, in which the number of entire initialization sub-fields has been increased, the initializing voltage in the increased entire initialization sub-field is set at a lower voltage than the initializing voltages in all the other entire initialization sub-fields. In a field immediately before the sub-field, in which the number of entire initialization sub-fields is to be decreased, the initializing voltage of the to-be-decreased entire initialization sub-field is set at a lower voltage than the initializing voltages in all the other entire initialization sub-fields. These preparations allow equalizing the values of black luminance before and after the change in the number of entire initializations, and lowering the black luminance of the sub-fields, in which the entire initializing operation is switched over to the selective initializing operation or vice versa, than the black luminance of the sub-field in which no switchover is done. As a result, the flicker becomes inconspicuous.

It is further preferable to regulate the initializing voltage in the following way: in the field immediately after the field in which the number of entire initialization sub-fields has been increased, the luminance of light emission due to initializing discharge in the increased entire initialization sub-field is lower than a half of the luminance of light emission due to initialization discharges in all the other entire initialization sub-fields, and in the field immediately before the field in which the number of entire initialization sub-fields is to be decreased, the luminance of light emission due to initializing discharge in the to-be-decreased entire initialization sub-field is lower than a half of the luminance of light emission due to initialization discharges in all the other entire initialization sub-fields.

In a plasma display device of the present invention, a variation with hysteresis characteristics in the number of entire initializations allows suppressing frequent changes of the black luminance, so that the picture quality can be further improved. A method of how the variation in the number of entire initializations is accompanied by the hysteresis characteristics is described hereinafter.

Table 2 shows a relation between APL and the number of entire initializations. In this eighth embodiment, when the number of entire initializations is changed based on APL as the first embodiment does, the hysteresis characteristics work in this changing operation.

TABLE 2

| APL | The number of entire initialization | The number of entire initialization sub-field |
|---|---|---|
| Less than 7% | 1 | 1 |
| Not less than 5% | 2 | 1, 4 |

Table 2 differs from Table 1 in that the values of APL do not always correspond to the number of entire initializations on one-to-one basis, and there is a range where the number of entire initialization is not determined uniquely. When APL stays in the range of not less than 5% and less than 7%, the number of entire initializations is one or two, so that it can be concluded that the variation based on APL in the number of entire initializations can be accompanied by the hysteresis characteristics.

To be more specific, when APL decreases and the number of entire initializations is reduced from two to one, the reduction in number is not carried out when APL becomes less than 7%, but it is carried out (reduction from two to one) when APL becomes less than 5%. To the contrary, when APL increases and the number of entire initializations is increased from one to two, the number increment is not carried out when APL becomes not less than 5%, but it is carried out (increase from one to two) when APL becomes not less than 7%.

Under the foregoing control without the hysteresis characteristics as shown in table 1, when APL changes 8, 6, 4, 6, 5, 3, , , , (%) along the time axis, the number of entire initializations changes frequently in synchronization with the changes of APL like 2, 2, 1, 2, 1, 1, , , , (times), which results in frequent changes of the black luminance that should stay constant. As a result, the picture quality lowers. However, this eighth embodiment changes the number of entire initialization sub-fields by using the hysteresis characteristics as shown in table 2, so that the number of entire initializations becomes 2, 2, 1, 1, 1, 1, 1, , , , (times) and the frequency of changes in the black luminance becomes smaller.

As discussed above, the change with the hysteresis characteristics in the number of entire initializations can prevent the foregoing videos from frequent changes in the number of entire initializations, so that frequent changes in the black luminance can be prevented.

In this eighth embodiment, the number of entire initializations is changed based on APL; however, the panel driving method of the present invention can be used when the number of entire initializations is changed based on another parameter, such as a panel temperature or hours of using the panel.

In this eighth embodiment, the partial pressure ratio of xenon in discharge gas is 10%; however, another partial pressure ratio can be used if a driving voltage appropriate to the panel is employed.

The specific numbers used in the previous embodiments of the present invention are only an instance, so that it is preferable to set the numbers appropriately to the panel characteristics or the specifications of plasma display devices.

INDUSTRIAL APPLICABILITY

Variations in the number of entire initializations allow stabilizing address discharges and making changes in the black luminance inconspicuous, so that the picture quality can be improved. The present invention is thus useful for a method of driving panels to be used in wall-mounted television receivers or large-size monitors. The present invention is also useful for plasma display devices.

The invention claimed is:

1. A method of driving a plasma display panel including a plurality of discharge cells including a display electrode pair having a scan electrode and a sustain electrode, wherein one field is formed of a plurality of sub-fields each of which includes an initializing period during which initializing discharge takes place in the discharge cells, and an addressing period during which address discharge takes place in the discharge cells, and a sustained period where sustain discharge takes place in the discharge cells, the method comprising the steps of:

setting each one of the sub-fields as one of an entire initialization sub-field and a selective initialization sub-field, wherein in the entire initialization sub-field, the initializing discharge takes place during the initializing period at all discharge cells that are involved in displaying a video, and in the selective initialization sub-field, the initializing discharge takes place during the initializing period at a selective discharge cell, wherein the sustain discharge has taken place in a sub-field immediately before the initializing period:

controlling an initializing voltage which generates initializing discharge in the entire initialization sub-field when the entire initialization sub-field is switched over to the selective initialization sub-field or vice versa; and setting an initializing voltage of at least one of the entire initialization sub-fields in a field immediately before a field, in which a number of entire initialization sub-fields is increased, higher than an initializing voltage of at least two of the entire initialization sub-fields in a field immediately after a field in which the number of the entire initialization sub-fields has been increased.

2. The method of claim 1 further comprising the step of:

setting an initializing voltage of at least two of the entire initialization sub-fields in a field immediately before a field, in which a number of entire initialization sub-fields is decreased, lower than an initializing voltage of at least one of the entire initialization sub-fields in a field immediately after a field in which the number of the entire initialization sub-fields has been decreased.

3. The method of claim 1 further comprising the steps of:

raising an initializing voltage of the entire initialization sub-field in one field step by step over a period of a consecutive plurality of fields; and switching the selective initialization sub-field to the entire initialization sub-field.

4. The method of claim 1 further comprising the steps of:

switching one of the entire initialization sub-fields in one field to one of the selective initialization sub-fields; and lowering an initializing voltage of at least one of the remaining entire initialization sub-fields step by step over a period of a consecutive plurality of fields.

5. The method of claim 1 further comprising the steps of:

raising an initializing voltage of the entire initialization sub-field step by step for a period of 0.2 second - 1.6 seconds; and switching the selective initialization sub-field to the entire initialization sub-field.

6. A plasma display device comprising:

a plasma display panel including a plurality of discharge cells having a display electrode pair formed of a scan electrode and a sustain electrode; and a scan-electrode driving circuit for applying a voltage in an inclined waveform gently rising or falling to the scan electrode;

wherein one field is formed of a plurality of sub-fields each of which includes an initializing period where initializing discharge takes place in the discharge cells, and an addressing period where address discharge takes place in the discharge cells, and a sustained period where sustain discharge takes place in the discharge cells, wherein each one of the sub-fields is one of an entire initialization sub-field and a selective initialization sub-field, wherein in the entire initialization sub-field, the initializing discharge takes place during the initializing period at all discharge cells that are involved in displaying a video, and in the selective initialization sub-field, the initializing discharge takes place during the initializing period at a selective discharge cell, wherein the sustain discharge has taken place in a sub-field immediately before the initializing period wherein the scan-electrode driving circuit switches the entire initialization sub-field to the selective initialization sub-field or vice versa, and controls an initializing voltage that is a maximum value of a voltage in an inclined waveform which is used for generating an initializing voltage in the entire initialization sub-field; and wherein the scan-electrode driving circuit raises the initializing voltage of the entire initialization sub-field in one field step by step for 0.2 second - 1.6 seconds, then switches the selective initialization sub-field to the entire initialization sub-field.

7. The plasma display device of claim 6, wherein the scan-electrode driving circuit switches one of the entire initialization sub-fields in one field to the selective initialization sub-field, then lowers an initializing voltage of at least one of the remaining entire initialization sub-fields step by step for 0.2 second - 1.6 seconds.

8. The plasma display device of claim 6, wherein the scan-electrode driving circuit lowers an initializing voltage of the entire initialization sub-field in a field immediately after a field, in which the selective initialization sub-field is switched to the entire initialization sub-field, to a voltage lower than an initializing voltage of the other entire initialization sub-fields.

9. The plasma display device of claim 6, wherein the scan-electrode driving circuit lowers an initializing voltage of one of the entire initialization sub-fields in a field immediately before a field, in which the entire initialization sub-field is switched to the selective initialization sub-field, to a voltage lower than an initializing voltage of the remaining entire initialization sub-fields.

* * * * *